US008644732B2

(12) United States Patent
Kikuchi et al.

(10) Patent No.: US 8,644,732 B2
(45) Date of Patent: Feb. 4, 2014

(54) PHOTOSENSITIVE DRUM UNIT, ASSEMBLING METHOD THEREFOR, AND DISASSEMBLING METHOD THEREFOR

(75) Inventors: Ken Kikuchi, Mishima (JP); Yoshiyuki Batori, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/563,044

(22) Filed: Jul. 31, 2012

(65) Prior Publication Data

US 2012/0294649 A1 Nov. 22, 2012

Related U.S. Application Data

(63) Continuation of application No. PCT/JP2011/052679, filed on Feb. 2, 2011.

(30) Foreign Application Priority Data

Feb. 2, 2010 (JP) ..... 2010-021126
Jan. 5, 2011 (JP) ..... 2011-000440

(51) Int. Cl.
*G03G 15/00* (2006.01)

(52) U.S. Cl.
USPC ..... 399/117

(58) Field of Classification Search
USPC ..... 399/117, 116
See application file for complete search history.

(56) References Cited

U.S. PATENT DOCUMENTS 5,911,096 A 6/1999 Batori et al.
5,920,753 A 7/1999 Sasaki et al.
5,930,562 A 7/1999 Noda et al.
5,937,237 A 8/1999 Nonaka et al.
5,940,658 A 8/1999 Yokoi et al.
6,075,957 A 6/2000 Batori et al.
6,101,348 A 8/2000 Nonaka et al.
6,131,007 A 10/2000 Yamaguchi et al.
6,275,668 B1 8/2001 Batori
6,334,035 B1 12/2001 Abe et al.
6,363,226 B1 3/2002 Batori
6,714,746 B2 3/2004 Morioka et al.
6,735,405 B2 5/2004 Yokoi et al.
6,832,057 B2 12/2004 Oguma et al.
6,937,832 B2 8/2005 Sato et al.
6,952,544 B2 10/2005 Kikuchi et al.
6,963,706 B2 11/2005 Morioka et al.

(Continued)

FOREIGN PATENT DOCUMENTS

JP 1164818 A 6/1989
JP 2002048148 A 2/2002

(Continued)

OTHER PUBLICATIONS

International Search Report PCT/JP2011/052679 mailed Mar. 8, 2011, Japanese Patent Office (ISA).

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

A photosensitive drum unit is provided, to which a coupling member is easily mounted. A drum flange is fixed to one end portion of a cylinder having a photosensitive layer at a peripheral surface. The coupling member is inserted into the drum flange. Finally, a closing member is mounted to the drum flange.

22 Claims, 24 Drawing Sheets

(56) References Cited

U.S. PATENT DOCUMENTS

| | | | | |
|---|---|---|---|---|
| 7,073,251 | B2 | 7/2006 | Kikuchi et al. | |
| 7,079,787 | B2 | 7/2006 | Ogino et al. | |
| 7,127,192 | B2 | 10/2006 | Batori et al. | |
| 7,136,604 | B2 | 11/2006 | Chadani et al. | |
| 7,200,349 | B2 | 4/2007 | Sato et al. | |
| 7,296,341 | B2 | 11/2007 | Kikuchi et al. | |
| 7,418,225 | B2 | 8/2008 | Morioka et al. | |
| 7,817,936 | B2 | 10/2010 | Kikuchi et al. | |
| 7,885,575 | B2 | 2/2011 | Batori et al. | |
| 7,983,597 | B2 | 7/2011 | Kikuchi | |
| 8,073,360 | B2 | 12/2011 | Kikuchi | |
| 8,081,898 | B2 | 12/2011 | Batori et al. | |
| 2002/0025191 | A1 | 2/2002 | Kitayama | |
| 2004/0005169 | A1* | 1/2004 | Yokomori et al. | 399/117 |
| 2008/0152388 | A1* | 6/2008 | Ueno et al. | 399/167 |
| 2008/0260428 | A1* | 10/2008 | Ueno et al. | 399/167 |
| 2009/0317129 | A1* | 12/2009 | Abe et al. | 399/111 |
| 2009/0317131 | A1* | 12/2009 | Morioka et al. | 399/117 |
| 2009/0317132 | A1* | 12/2009 | Asanuma et al. | 399/117 |
| 2010/0028050 | A1 | 2/2010 | Asanuma et al. | |
| 2010/0054823 | A1* | 3/2010 | Takasaka et al. | 399/286 |
| 2010/0080615 | A1 | 4/2010 | Kikuchi | |
| 2011/0033201 | A1 | 2/2011 | Akutsu et al. | |
| 2011/0038649 | A1* | 2/2011 | Miyabe et al. | 399/119 |
| 2011/0103812 | A1* | 5/2011 | Takasaka et al. | 399/44 |
| 2011/0142490 | A1 | 6/2011 | Kikuchi et al. | |
| 2011/0158661 | A1 | 6/2011 | Zona et al. | |
| 2011/0164897 | A1 | 7/2011 | Kikuchi | |
| 2011/0182619 | A1 | 7/2011 | Batori et al. | |
| 2012/0257908 | A1 | 10/2012 | Akutsu et al. | |
| 2012/0257909 | A1 | 10/2012 | Akutsu et al. | |

FOREIGN PATENT DOCUMENTS

| | | | |
|---|---|---|---|
| JP | 2008233867 | A | 10/2008 |
| JP | 2008233868 | A | 10/2008 |
| JP | 2010002689 | A | 1/2010 |

* cited by examiner (a)

S1—S1

(b)

S2—S2

(a)

(b)

(a)

(b)

(a)

(b)

(a)

(b)

(a)

(b)

(a)

(b)

(c)

(a)

(b)

PHOTOSENSITIVE DRUM UNIT, ASSEMBLING METHOD THEREFOR, AND DISASSEMBLING METHOD THEREFOR

FIELD OF THE INVENTION

The present invention relates to a photosensitive drum unit, an assembling method for the photosensitive drum unit, and a disassembling method for the photosensitive drum unit.

BACKGROUND ART

Conventionally, in an electrophotographic image forming apparatus using an electrophotographic image forming process, a photosensitive drum and process means actable on the drum is unified into a cartridge. The cartridge is detachably mountable to a main assembly of the electrophotographic image forming apparatus (process cartridge type). According to the process cartridge type, a maintenance operation for the image forming apparatus can be carried out by the user without relying on a service person, and therefore, an operationality of the maintenance operation can be improved remarkably.

A method is known in which a coupling member is provided at an end portion of the drum to rotation the drum, and a driving force is inputted to the coupling member from the main assembly of the apparatus. With such a structure, it is known that the coupling member is movable relative to the drum so that even if a positional relation between the cartridge and the main assembly of the apparatus is deviated, the drive can be transmitted to the drum with high accuracy (Japanese Laid-open Patent Application 2008-233867).

DISCLOSURE OF THE INVENTION

The present invention provides a further development of the above-described prior-art.

It is an object of the present invention to provide a photosensitive drum unit in which the coupling member can be easily mounted.

It is an object of the present invention to provide a photosensitive drum unit in which the coupling member can be easily dismounted.

It is an object of the present invention to provide a photosensitive drum unit disassembling method in which the coupling member can be easily mounted.

It is an object of the present invention to provide a photosensitive drum unit disassembling method in which the coupling member can be easily dismounted.

It is an object of the present invention to provide a photosensitive drum unit to which a coupling member is mountable, the coupling member including a rotational force receiving portion for receiving a rotational force at one end portion side thereof and a spherical portion at another end portion side, and including a projected portion projected from the spherical portion, said photosensitive drum unit comprising a cylinder provided with a photosensitive portion at a peripheral surface thereof; a drum flange provided at one end portion of said cylinder and including a hole portion which opens outwardly in a longitudinal direction of said cylinder and which has a opening capable of accommodating said spherical portion, a plurality of groove portions which continue from said hole portion and which is capable of accommodating said projected portion, and a regulating portion for limiting inward movement of said spherical portion in the longitudinal direction of said cylinder; and a closing member capable of partially covering said opening of said hole portion and mounted to said drum flange to limit outward movement of said spherical portion in the longitudinal direction of said cylinder.

It is another object of the present invention to provide an assembling method for a photosensitive drum unit, said assembling method comprising i) a drum flange mounting step of mounting a drum flange to one end portion of a cylinder having a photosensitive portion at a peripheral surface thereof, said drum flange including a hole portion having an opening which opens outwardly in the longitudinal direction of said cylinder, and a plurality of groove portions continuing from said hole portion; ii) a coupling member mounting step of mounting said coupling member, said coupling member including a rotational force receiving portion for receiving a rotational force at one end portion side thereof and a spherical portion at another end portion side, and including a projected portion projected from the spherical portion, and said coupling member mounting step inserting said spherical portion into said hole portion through said opening and inserting said projected portion into said groove portion; and iii) a closing member mounting step of mounting a closing member for partially covering said opening of said hole portion to said drum flange.

It is a further object of the present invention to provide a photosensitive drum unit disassembling method for disassembling a photosensitive drum unit, said photosensitive drum unit including a coupling member for receiving a rotational force for rotating a photosensitive drum having a cylinder provided with a photosensitive portion at a peripheral surface thereof, said coupling member including a rotational force receiving portion for receiving a rotational force at one end portion side thereof and a spherical portion at another end portion side, and including a projected portion projected from the spherical portion, said photosensitive drum, a drum flange provided at one end portion of said cylinder and including a hole portion which opens outwardly in a longitudinal direction of said cylinder and which has a opening capable of accommodating said spherical portion, a plurality of groove portions which continue from said hole portion and which is capable of accommodating said projected portion, and a closing member covering said opening of said hole portion and mounted to said drum flange to limit outward movement of said spherical portion in the longitudinal direction of said cylinder, said disassembling method being for removing said coupling member from said photosensitive drum unit and comprising i) a closing member dismounting step of dismounting said closing member from said drum flange; and ii) a coupling member dismounting step of dismounting said coupling member from said drum flange.

BRIEF DESCRIPTION OF THE DRAWINGS

Part (a) of FIG. 1 is a sectional view of an example of an electrophotographic image forming apparatus, and (b) is a sectional view of a process cartridge.

Part (a) of FIG. 2 shows an assembling step of the process cartridge, and (b) is a perspective view of the electrophotographic image forming apparatus in which a door is open.

Figure 3:
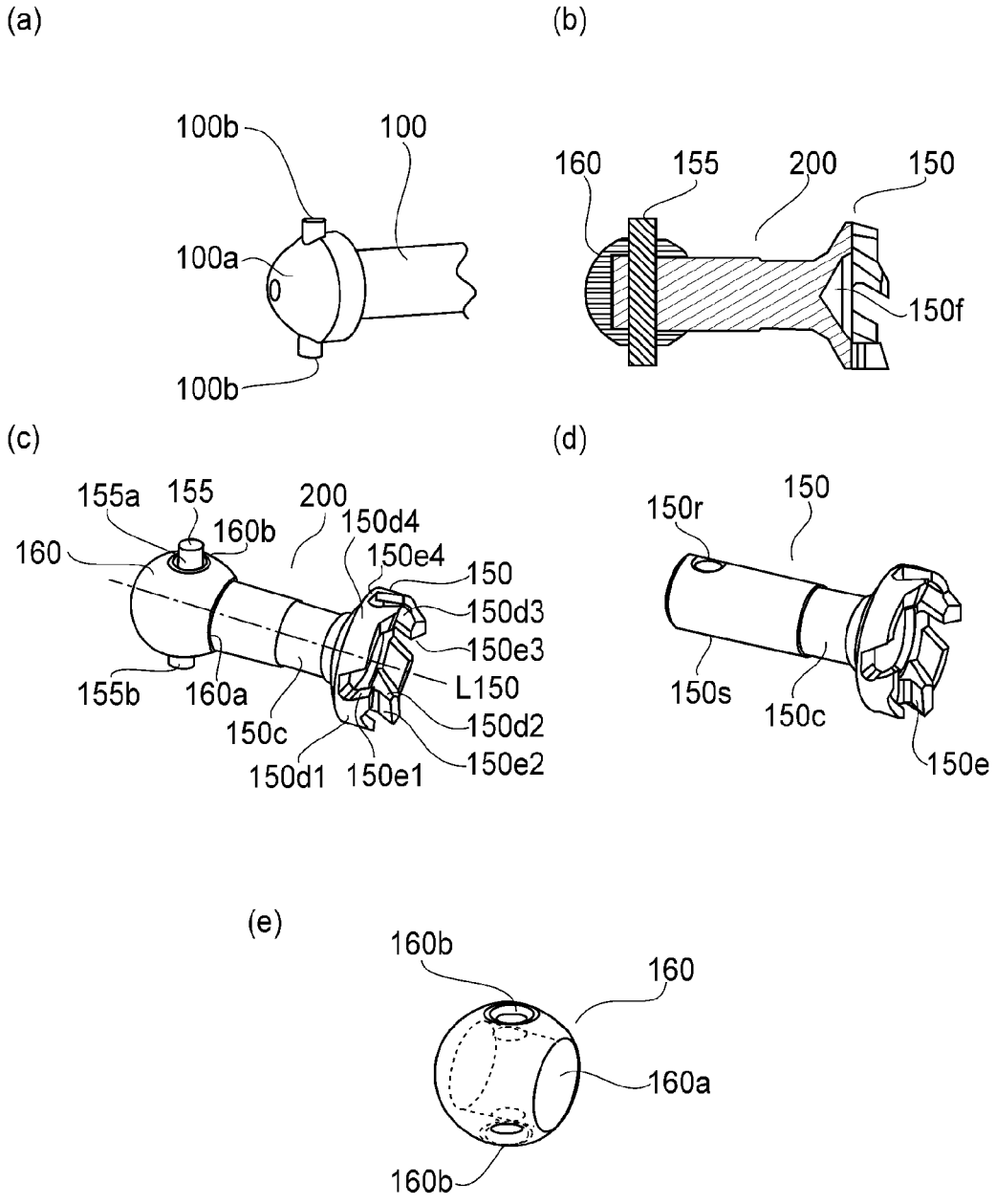

Part (a) of FIG. 3 is a perspective view of a driving shaft, (b) is a sectional view of a coupling member, (c) is a perspective view of the coupling member, (d) is a perspective view of a rotational force receiving member, and (e) is a perspective view of a spherical portion.

Figure 4:
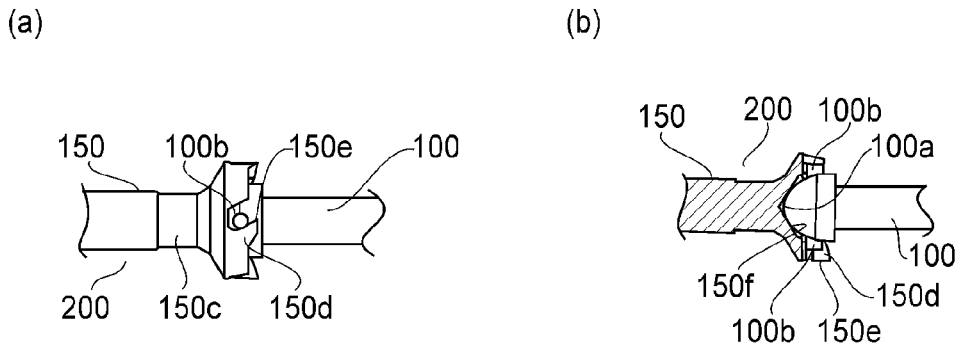

Part (a) of FIG. 4 is a side view of the coupling member and a driving shaft, and (b) is a sectional view of the coupling member and the driving shaft.

Figure 5:
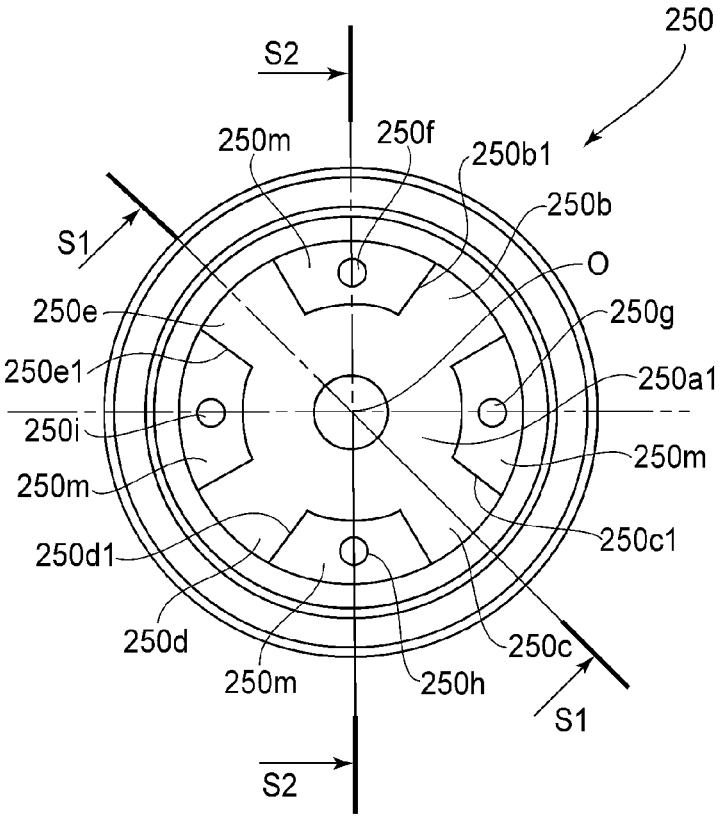

FIG. 5 is a front view of a drum flange.

Figure 6:
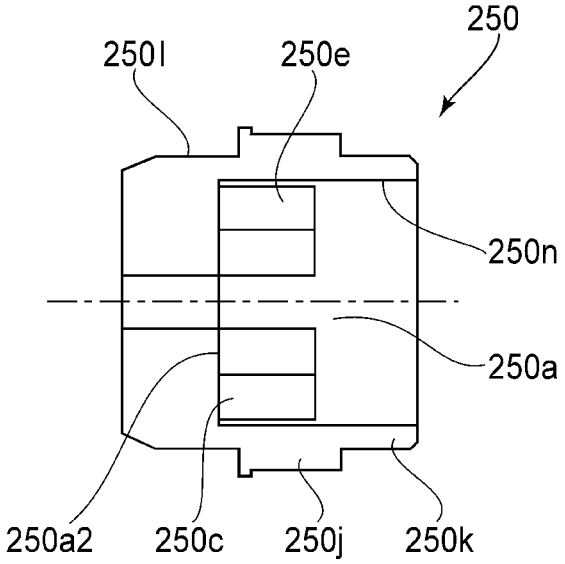
Figure 6:
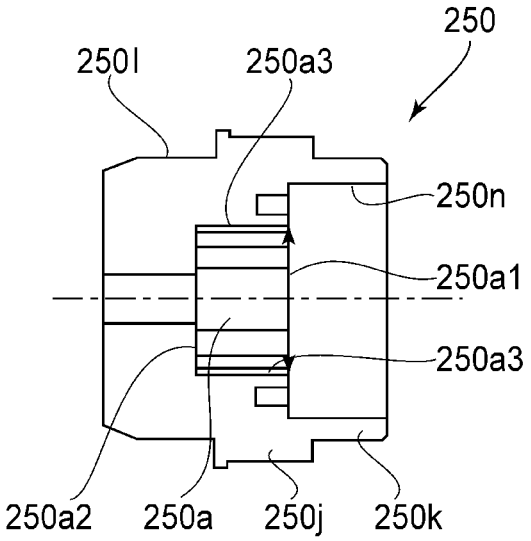

Parts (a) and (b) of FIG. 6 are sectional views of a drum flange.

Figure 7:
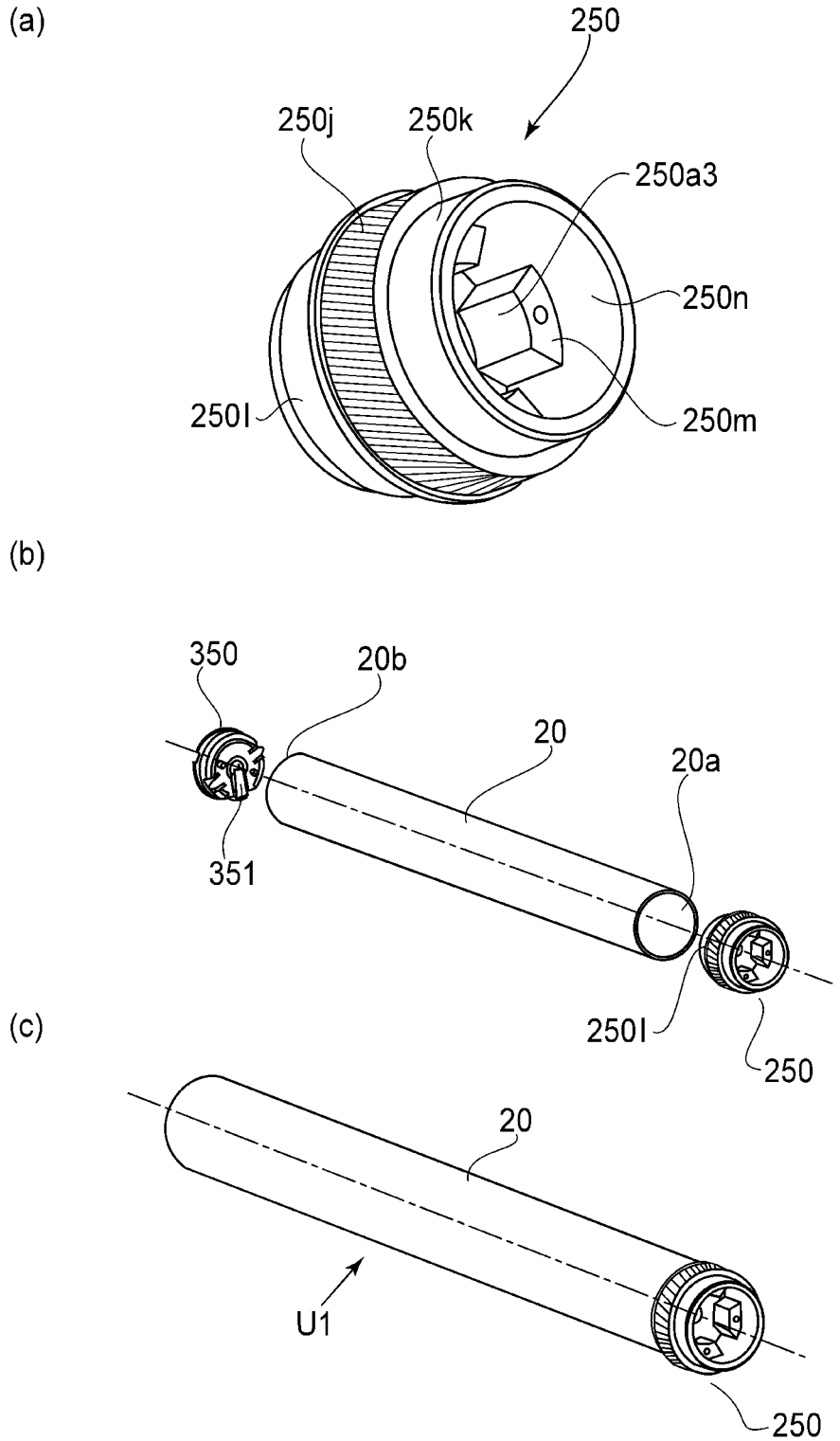

Part (a) of FIG. 7 is a perspective view of the drum flange, (b) is an exploded perspective view of a drum unit, and (c) is a perspective view of the drum unit.

Figure 8:
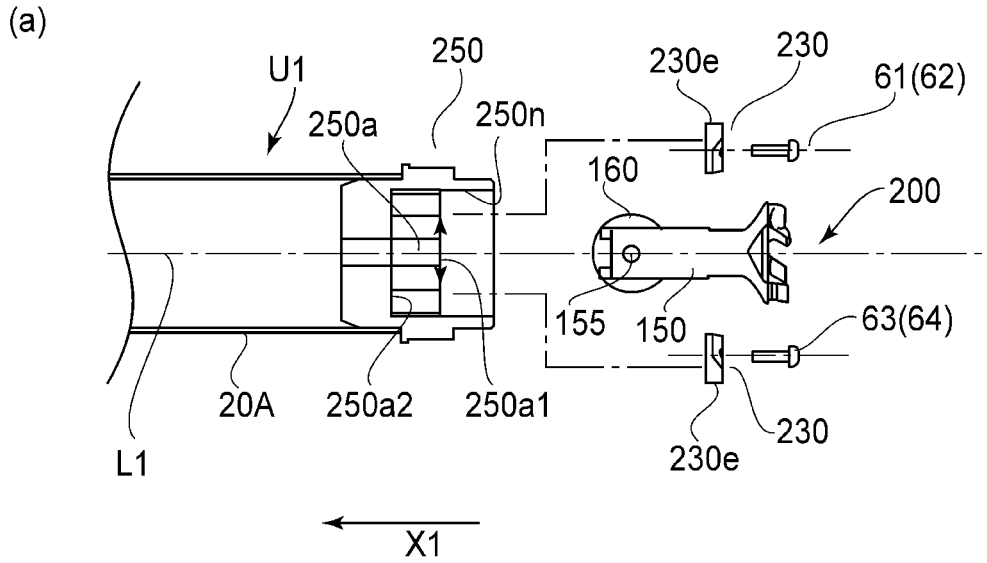
Figure 8:
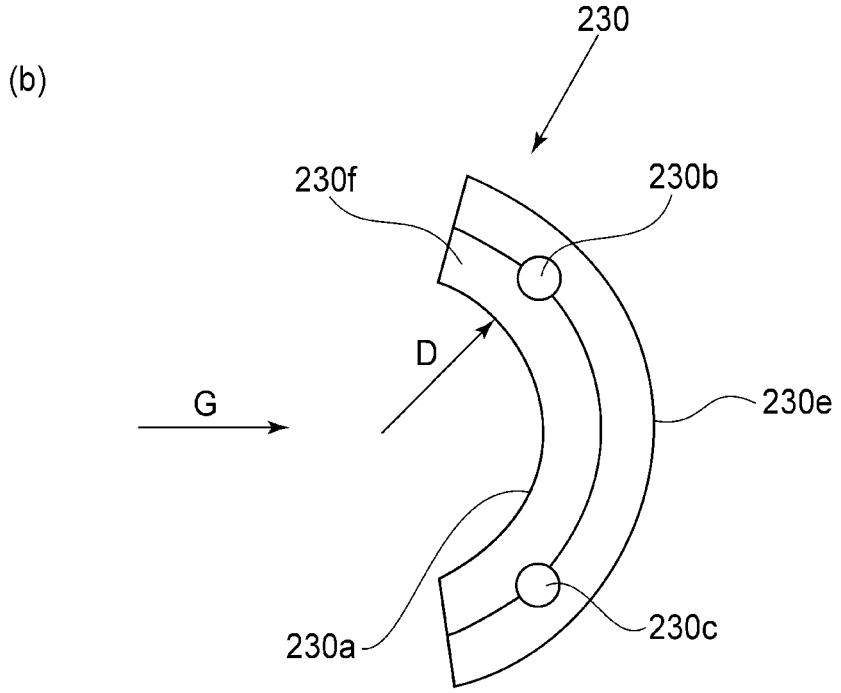

Part (a) of FIG. 8 is an exploded sectional view of the drum unit, and (b) is a front view of a closing member.

Figure 9:
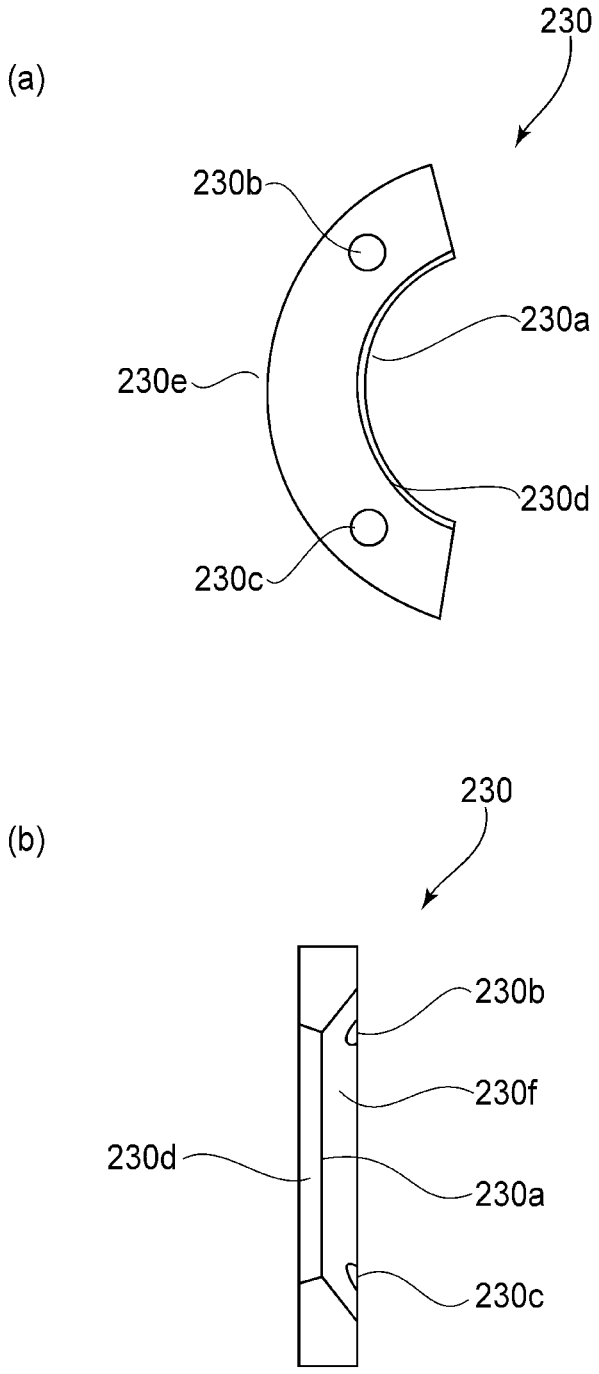

Part (a) of FIG. 9 is a rear view of the closing member, and (b) is a side view of the closing member.

Figure 10:
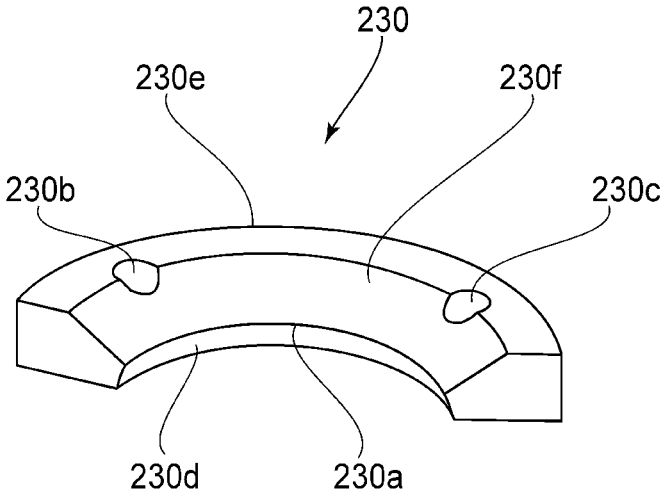
Figure 10:
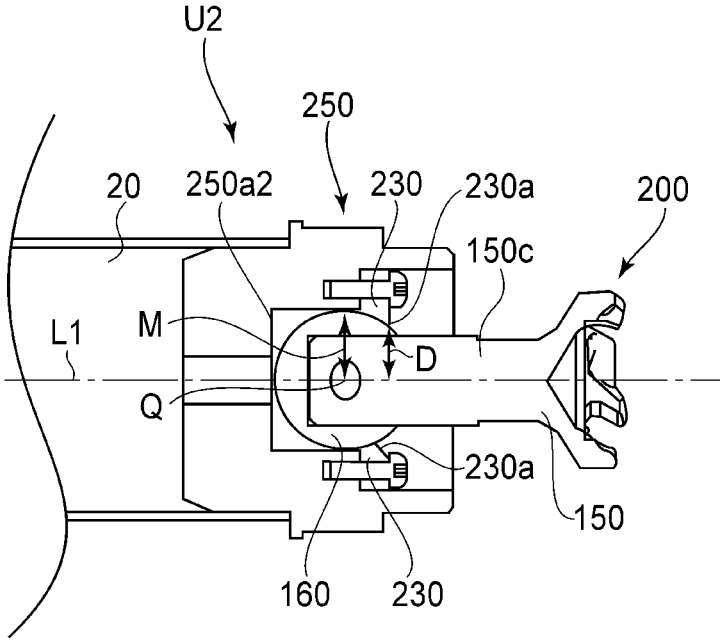

Part (a) of FIG. 10 is a perspective view of the closing member, and (b) is a sectional view of the drum unit.

Figure 11:
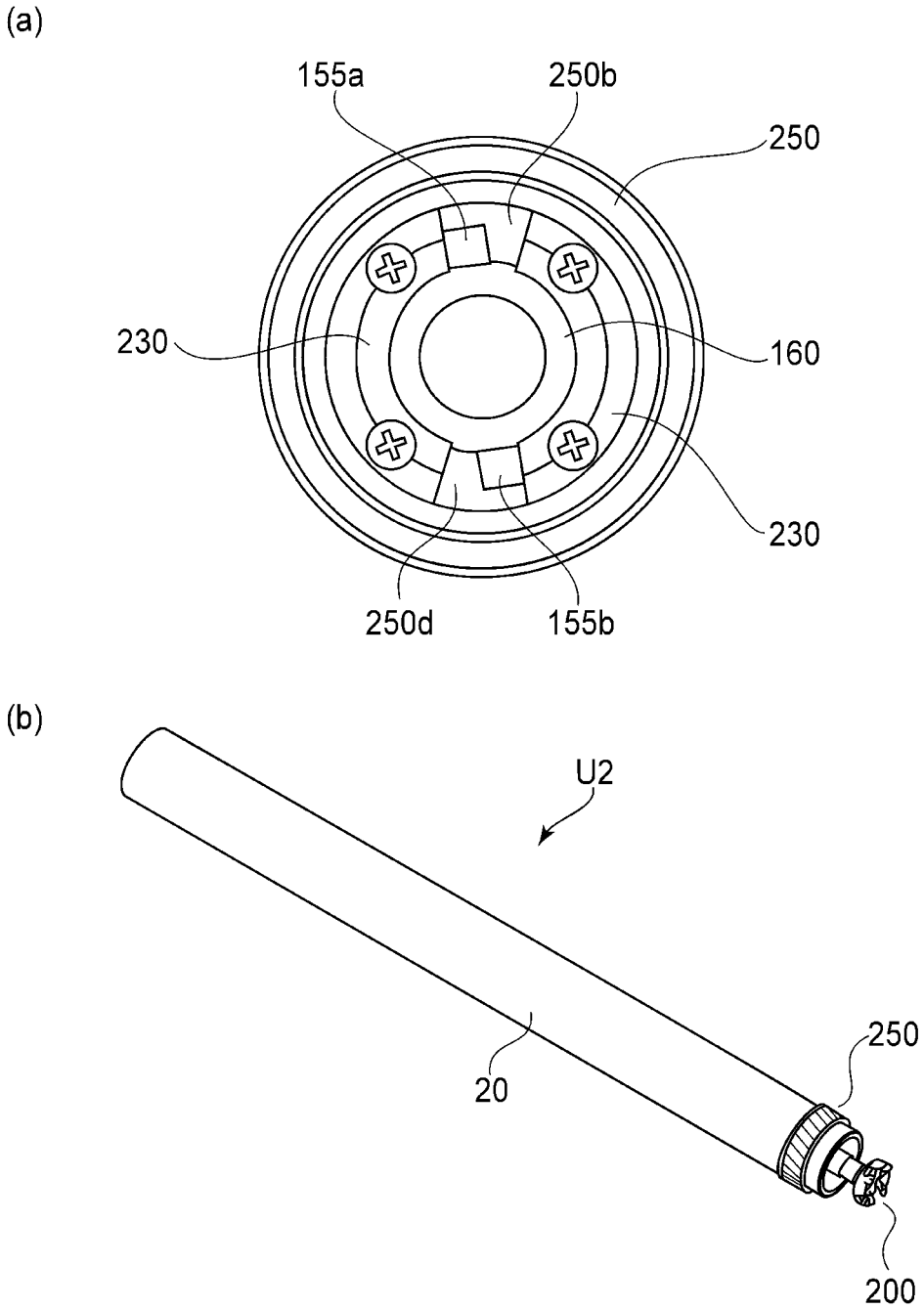

Part (a) of FIG. 11 is a sectional view of the drum unit, and (b) is a perspective view of the drum unit.

Figure 12:
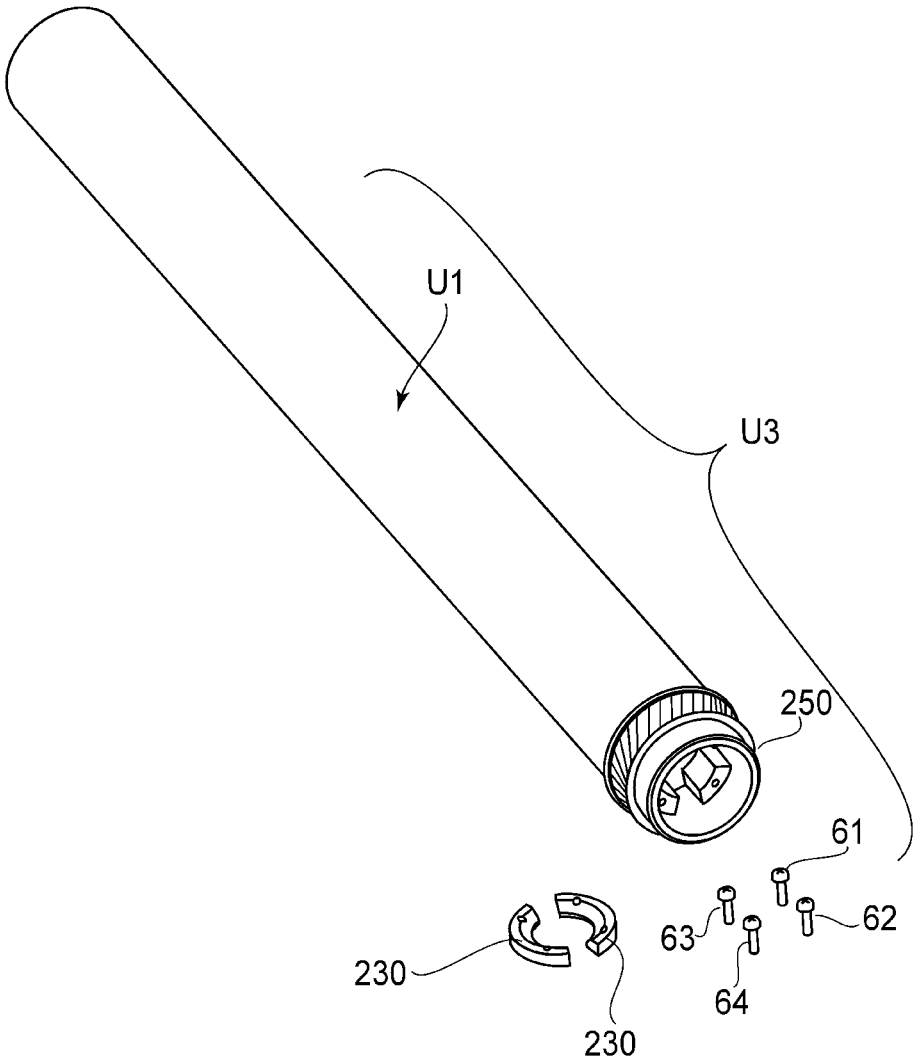

FIG. 12 is a perspective view of the drum unit.

Figure 13:
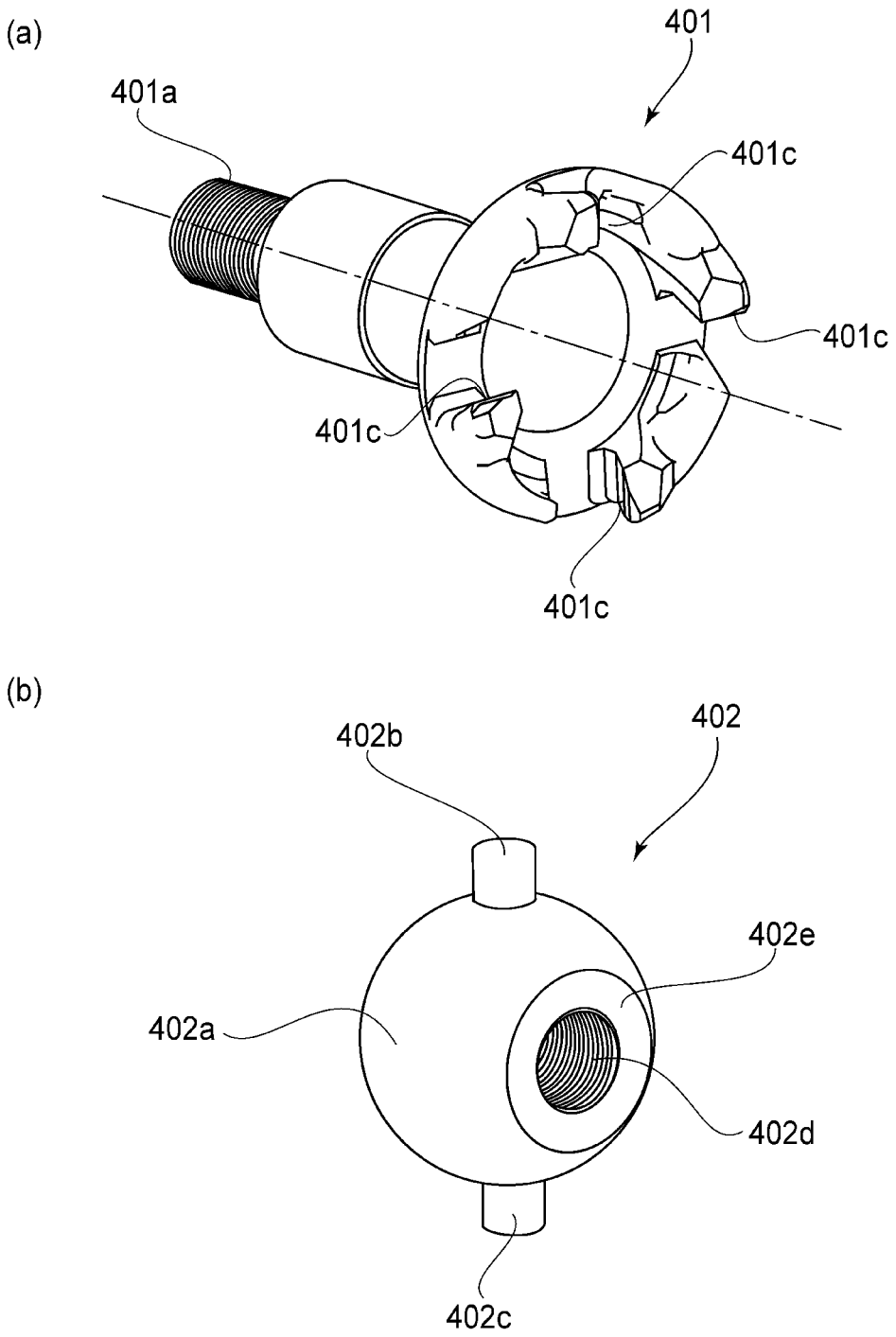

Part (a) of FIG. 13 is a perspective view of a rotational force receiving member according to an Embodiment 2, and (b) is a perspective view of a spherical member.

Figure 14:
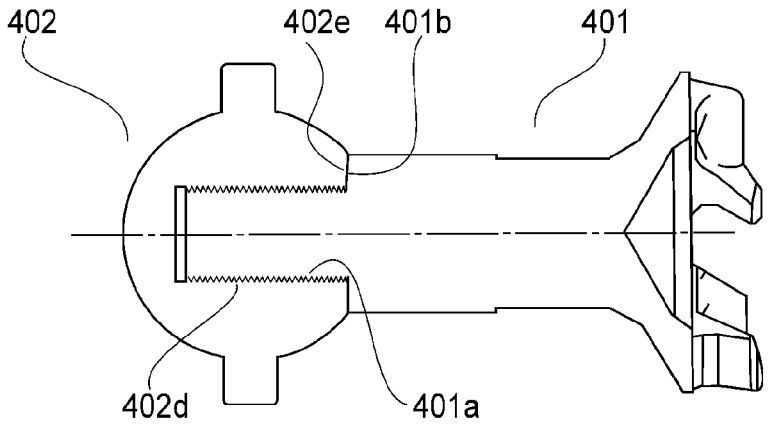
Figure 14:
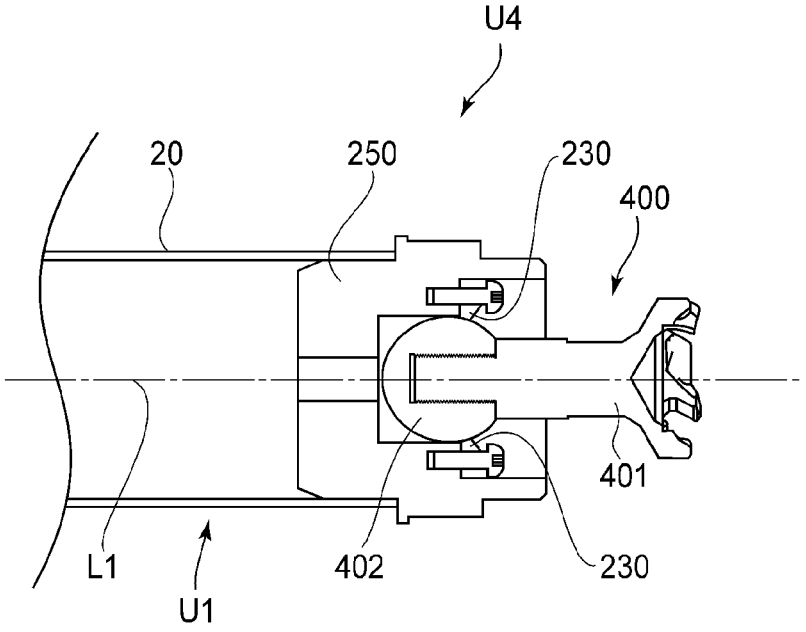

Part (a) of FIG. 14 is a sectional view of the coupling member, (b) is a sectional view of the drum unit.

Figure 15:
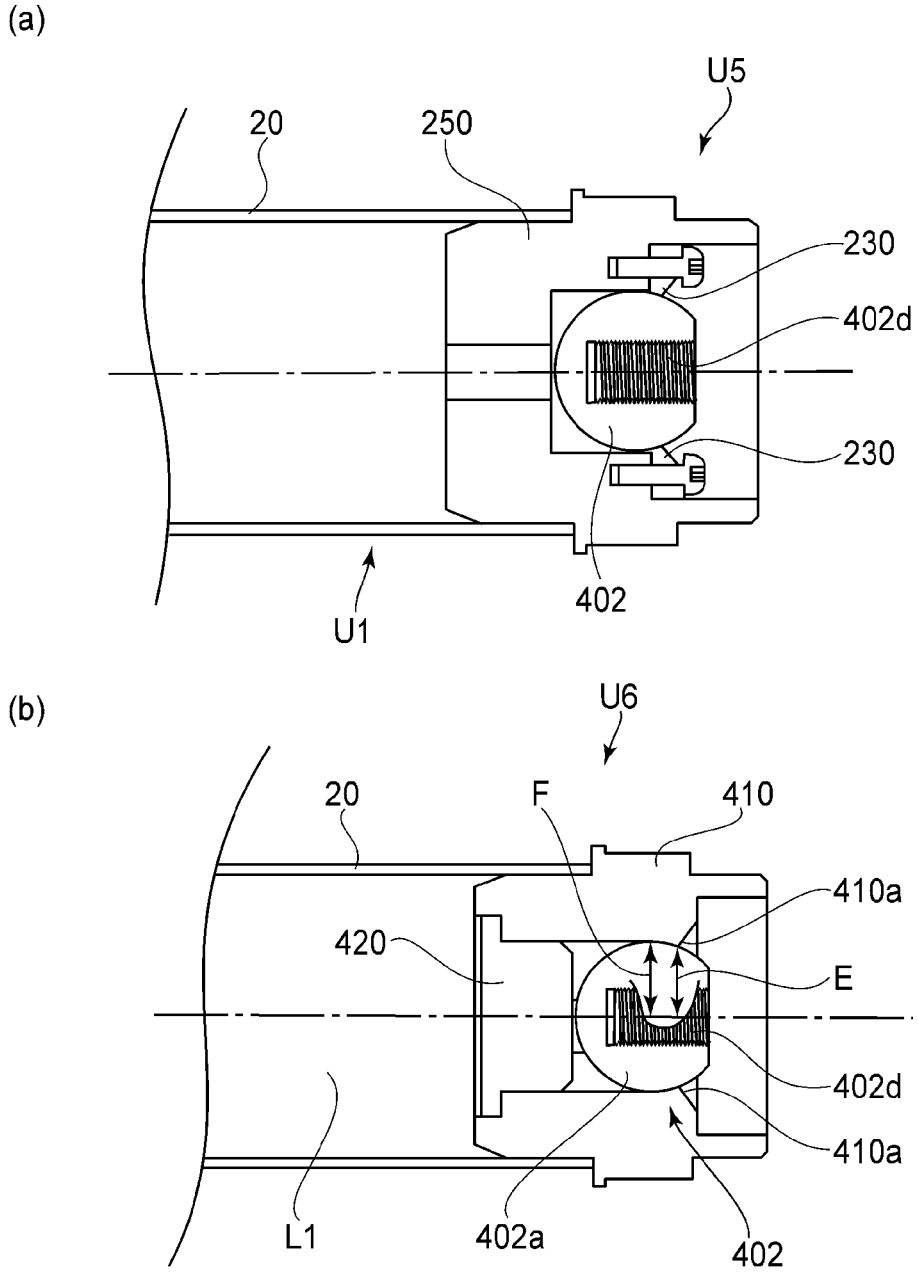

Parts (a) and (b) of FIG. 15 are sectional views of the drum unit.

Figure 16:
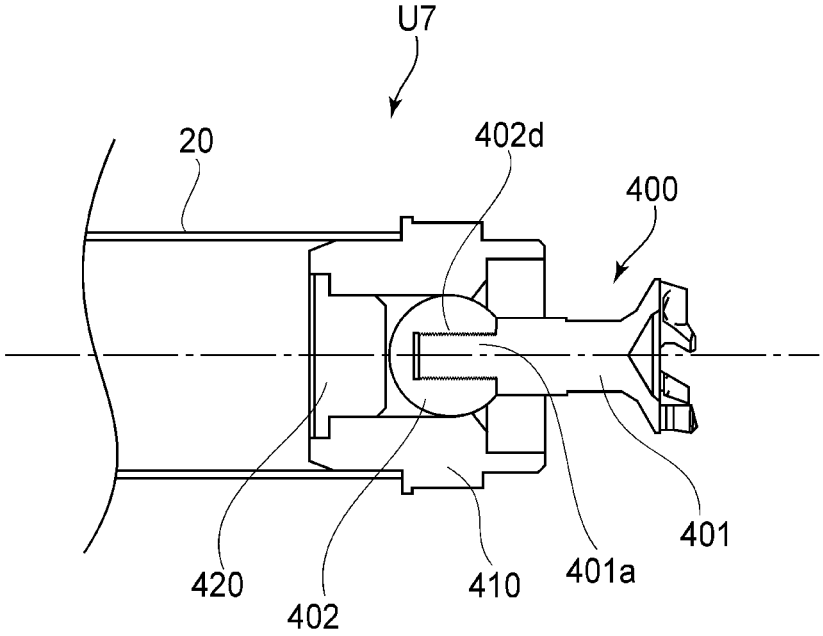

FIG. 16 is a sectional view of the drum unit.

Figure 17:
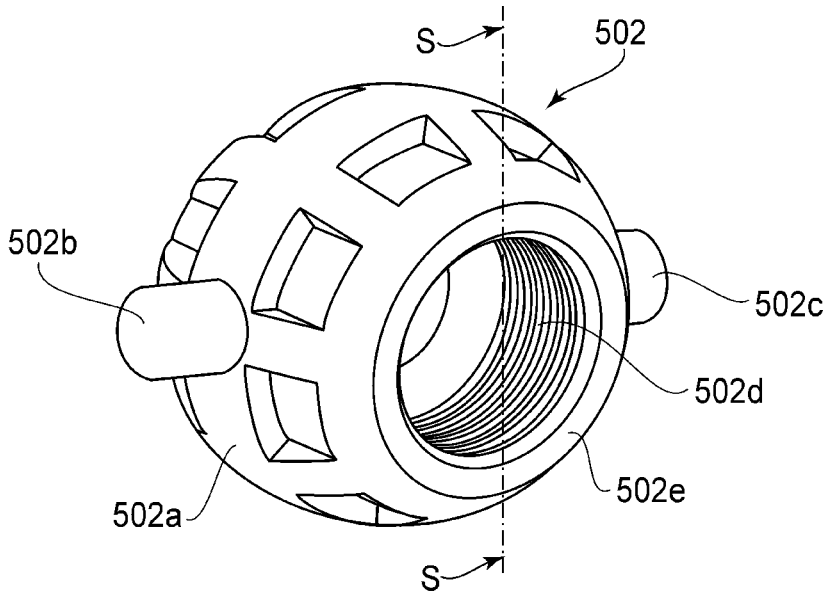
Figure 17:
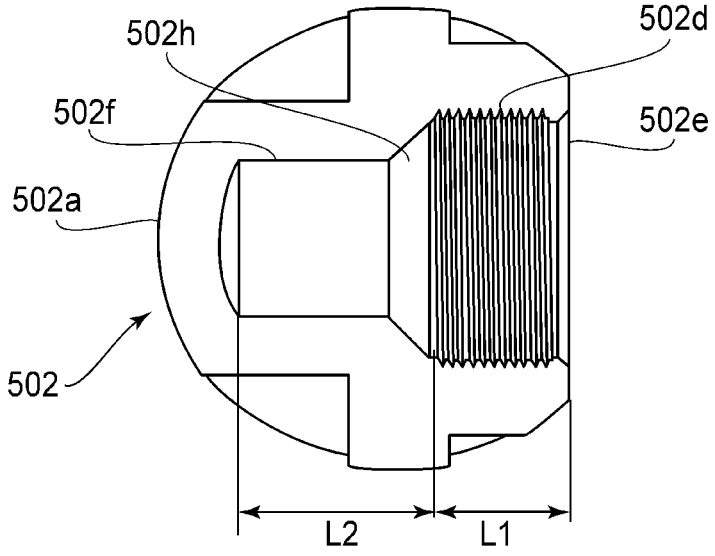

Part (a) of FIG. 17 is a perspective view of a spherical member according to Embodiment 3, and (b) is a sectional view of the spherical member taken along a plane S-S.

Figure 18:
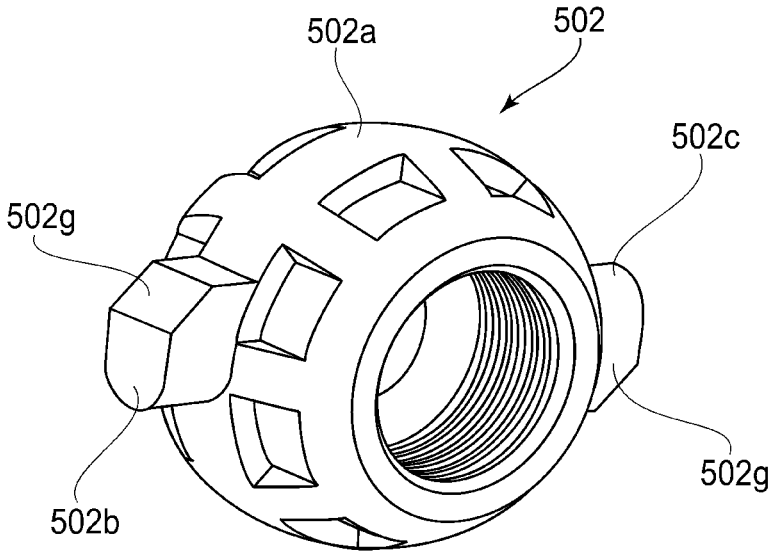

FIG. 18 is a perspective view of the spherical member provided with a reinforcing portion.

Figure 19:
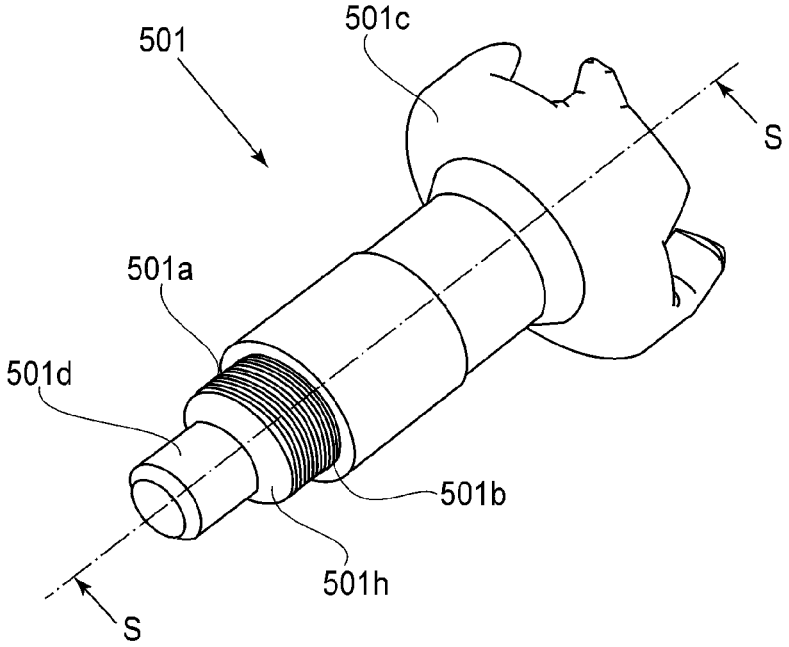
Figure 19:
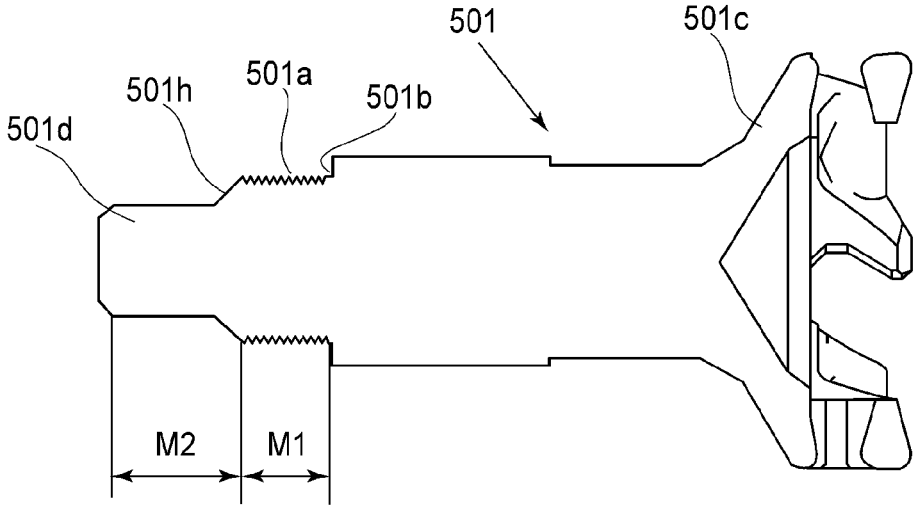

Part (a) of FIG. 19 is a perspective view of the rotational force receiving member, and (b) is a sectional view of the rotational force receiving member taken along a plane S-S.

Figure 20:
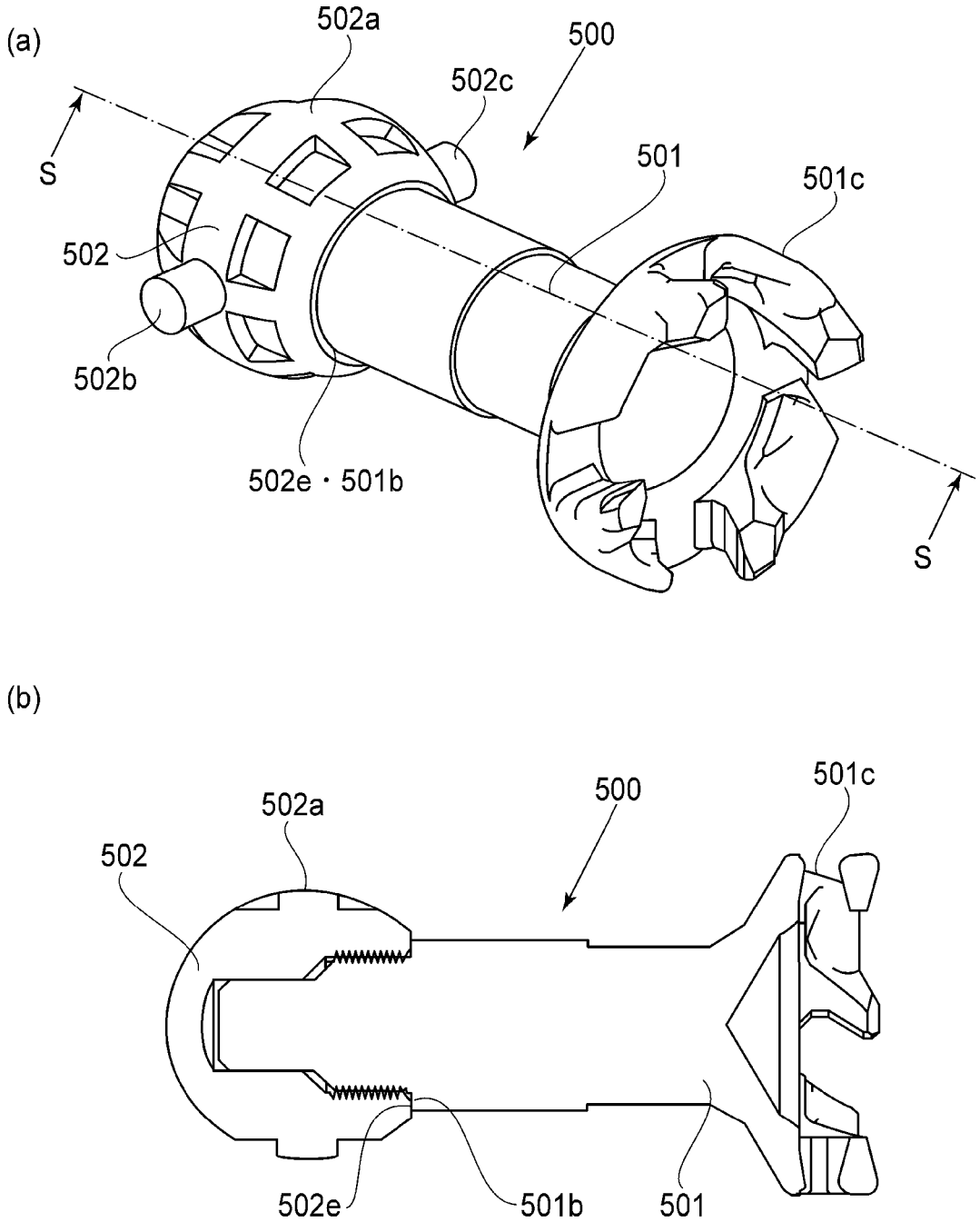

Part (a) of FIG. 20 is a perspective view of the coupling member, and (b) is a sectional view of the coupling member taken along a plane S-S.

Figure 21:
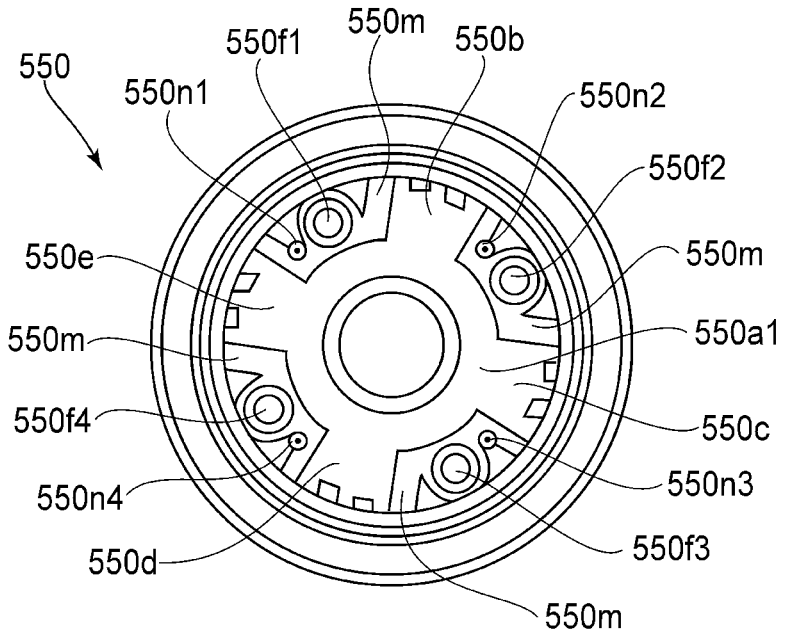
Figure 21:
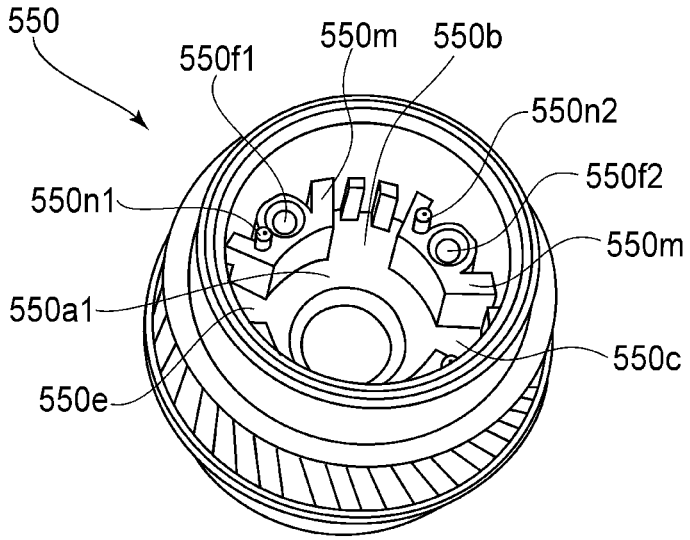

Part (a) of FIG. 21 is a front view of the drum flange according to Embodiment 3, as seen from the front side, and (b) is a perspective view.

Figure 22:
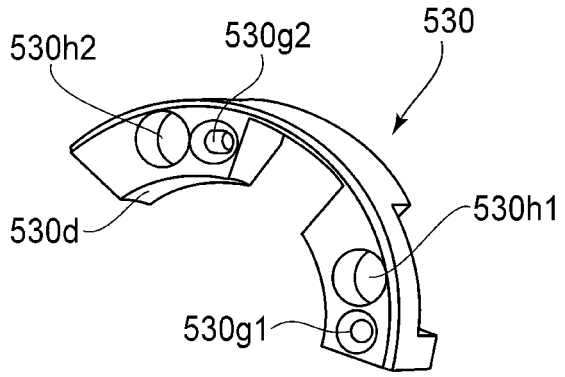
Figure 22:
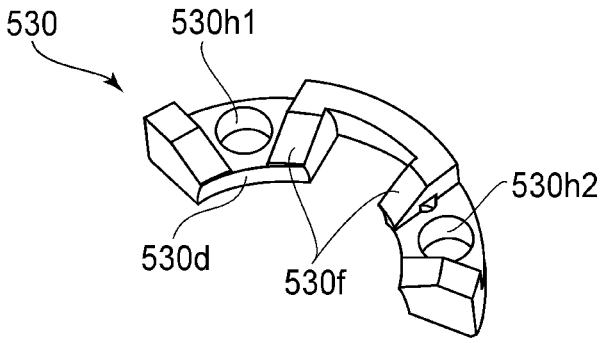
Figure 22:
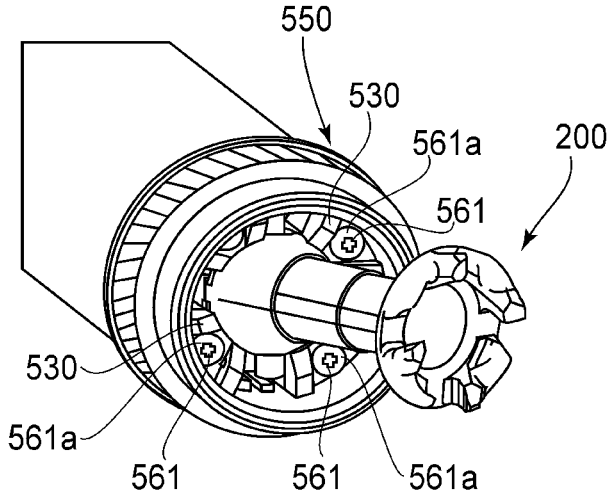

Part (a) of FIG. 22 is a perspective view of the closing member as seen from a back side, (b) is a perspective view of the closing member as seen from a front side, and (c) is a perspective view showing a state in which the drum flange, the closing member and the coupling member are fixed.

Figure 23:
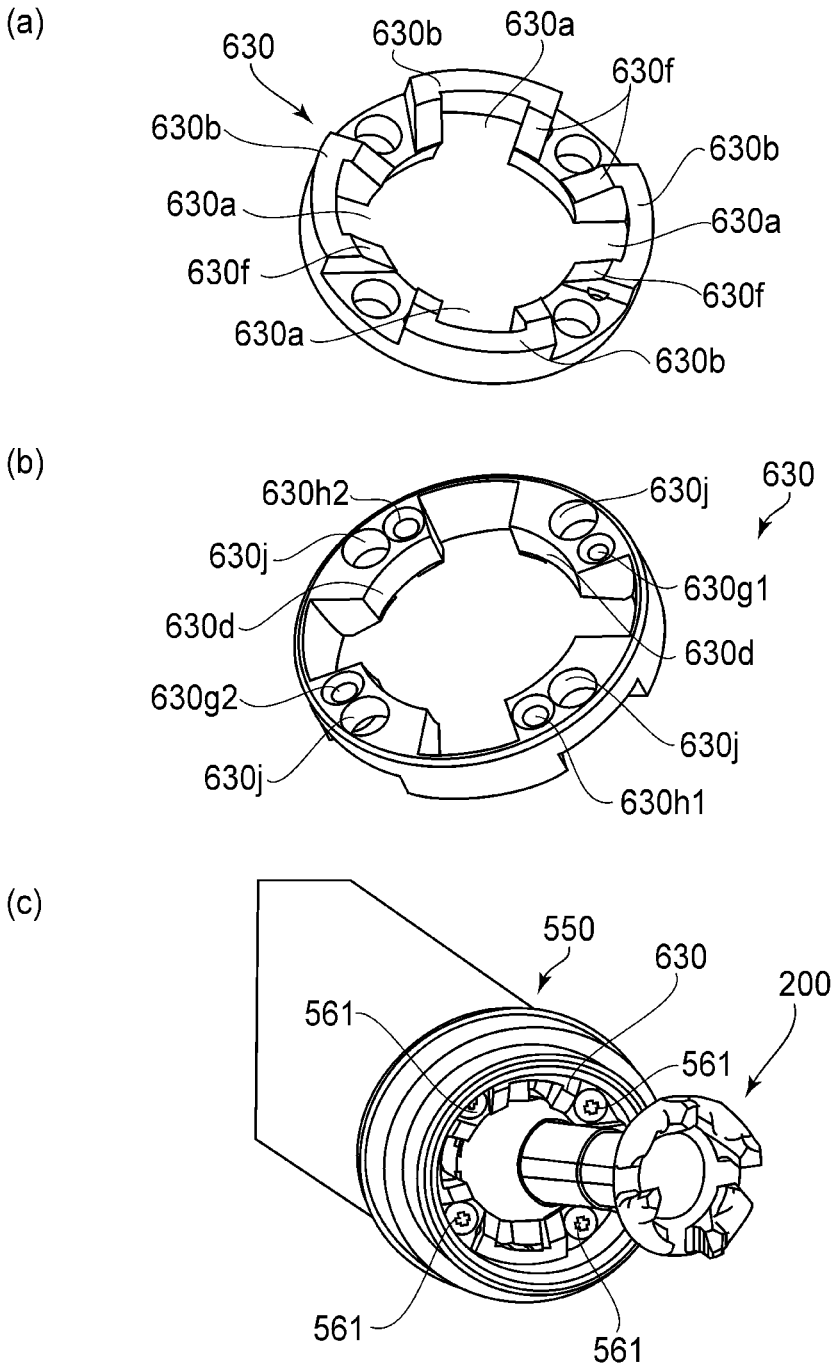

Part (a) of FIG. 23 is a perspective view of the closing member of Embodiment 5 as seen from the front side, (b) is a perspective view of the closing member as seen from the back side, and (c) is a perspective view showing a state in which the drum flange, the closing member and the coupling member are fixed.

Figure 24:
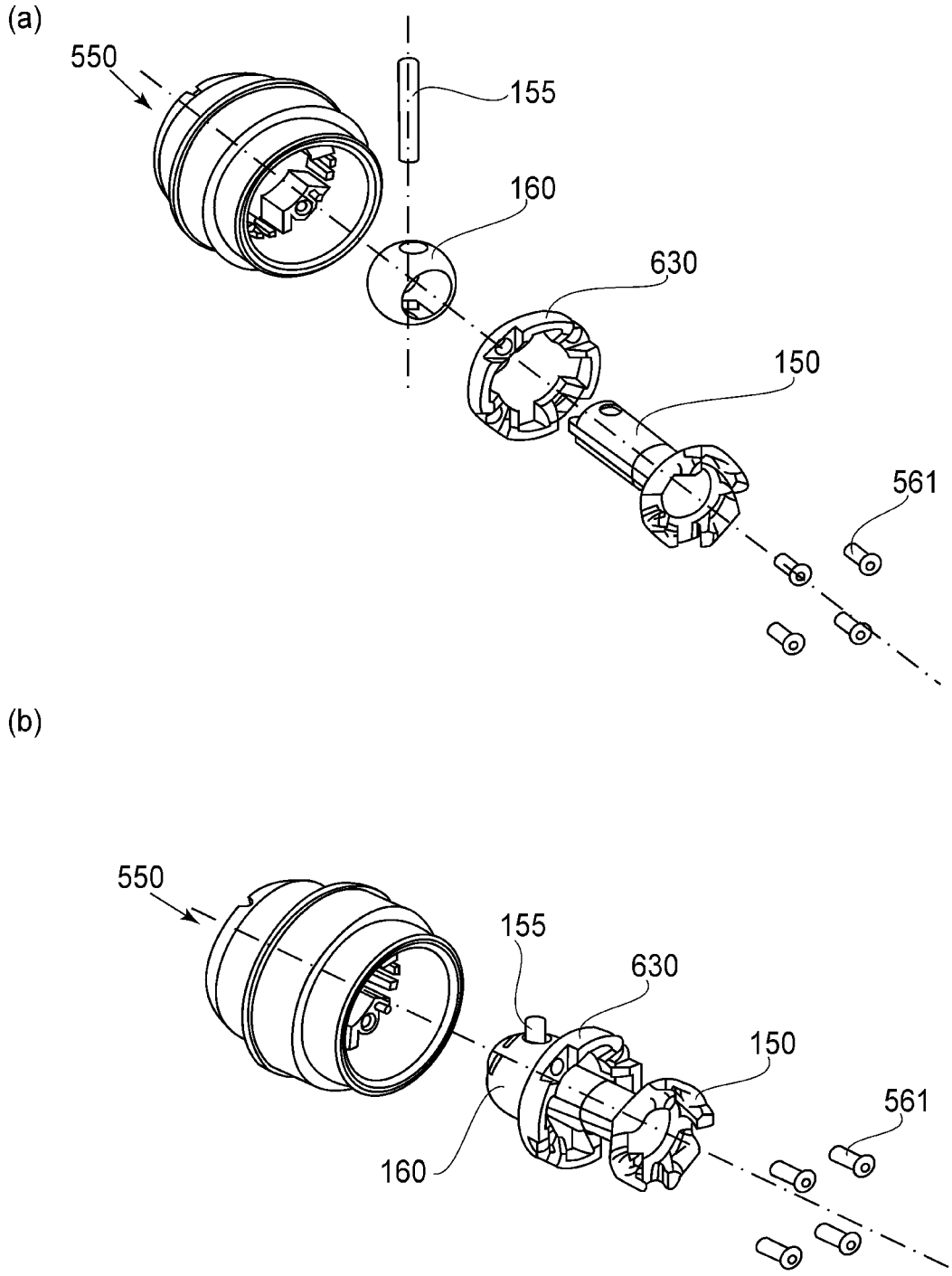

FIG. 24 is an illustration of an assembling method.

Figure 25:
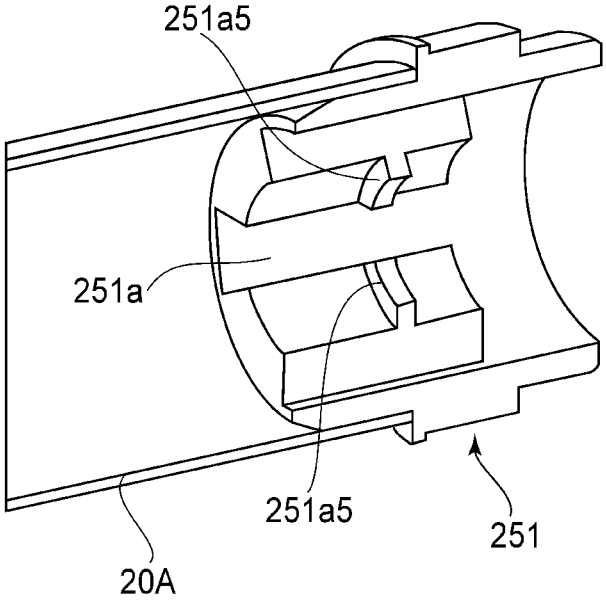
Figure 25:
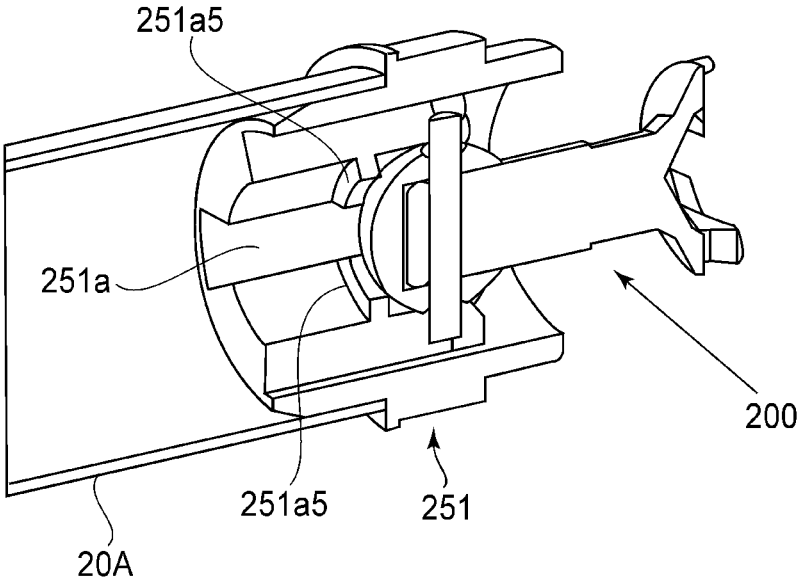

Part (a) of FIG. 25 is a perspective view of a drum flange according to a modified example of Embodiment 1, and (b) is a perspective view showing a state in which the coupling member is inserted into the drum flange.

PREFERRED EMBODIMENTS OF THE INVENTION

Referring to the drawings, the preferred embodiments of the invention will be described.

[Embodiment 1]

(General Arrangement)

Figure 1:
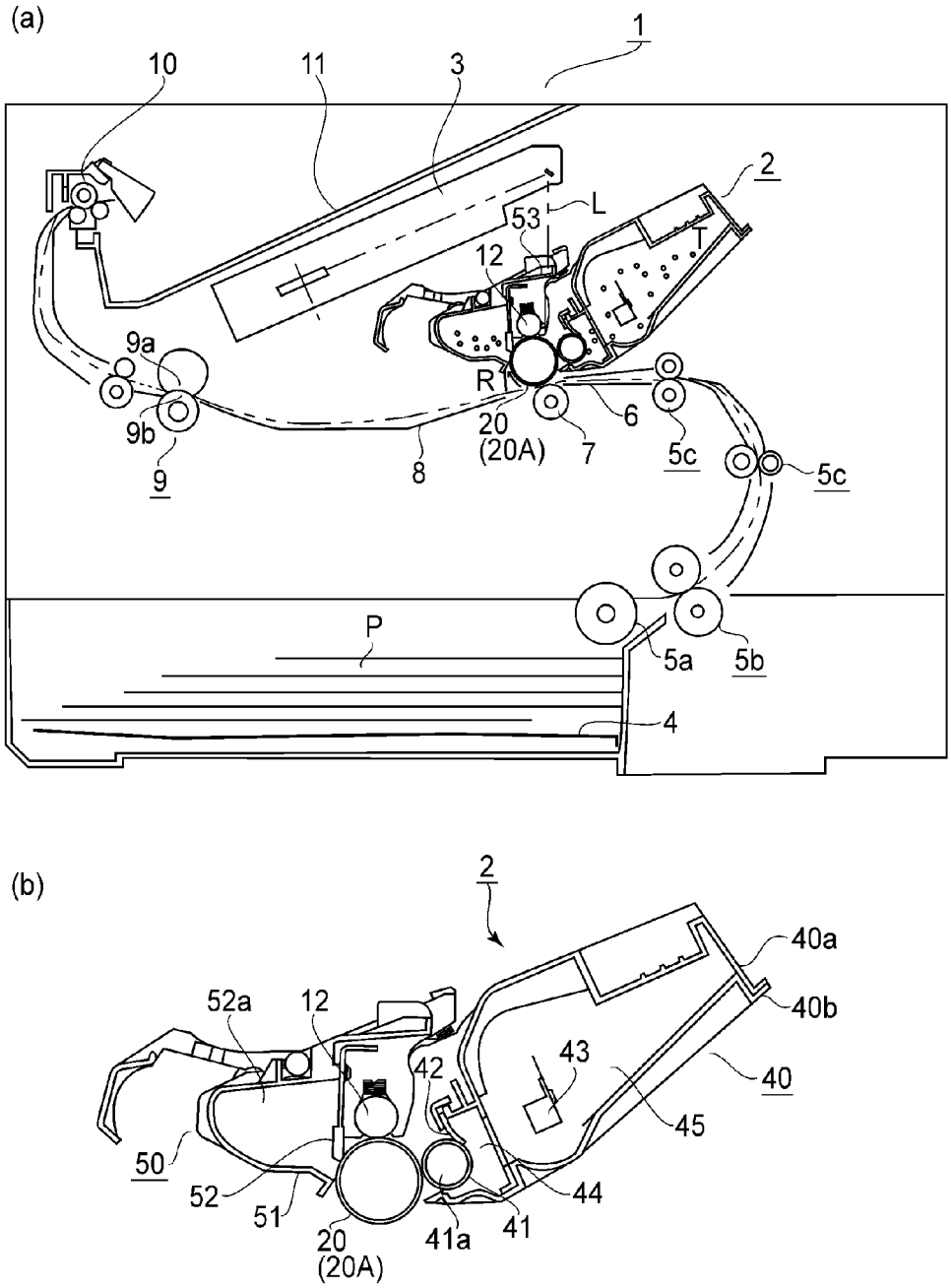

Part (a) of FIG. 1 is a sectional view of a main assembly of an electrophotographic image forming apparatus 1 (main assembly of the apparatus) and a process cartridge 2 (cartridge) according to this embodiment. Part (b) of FIG. 1 is an enlarged sectional view of the cartridge 2. Referring to parts (a) and (b) of FIG. 1, a general arrangement and an image forming process of the image forming apparatus according to this embodiment will be described.

The image forming apparatus is a laser beam printer using an electrophotographic technique in which the cartridge 2 is detachably mountable to the main assembly 1 of the apparatus. An exposure device (laser scanner unit) 3 is provided at a position above the cartridge 2 when the cartridge 2 is mounted to the main assembly 1 of the apparatus. A sheet tray 4 accommodating recording materials (sheet materials) P on which images are to be formed, is provided at a position below the cartridge 2.

Furthermore, the main assembly 1 of the apparatus includes a pick-up roller 5*a*, a feeding roller 5*b*, a pair of feeding rollers 5*c*, a transfer guide 6, a transfer roller 7, a feeding guide 8, a fixing device 9, a pair of discharging rollers 10, a discharge tray 11 and so on, which are provided in the order named along a feeding direction of the sheet material P.

(Image Forming Process)

An image forming process will be described. In response to printing instructions of the main assembly 1 of the apparatus, the electrophotographic photosensitive drum (drum) 20 is rotated in a direction of an arrow R1 at a predetermined peripheral speed (process speed). The drum 20 includes a cylinder 20A on which a photosensitive layer (photosensitive portion) is provided. To an outer surface of the drum 20, a charging roller 12 supplied with a bias voltage is contacted so that the outer surface of the drum 20 is charged uniformly by the roller 12.

From the exposure device 3, a laser beam L modulated corresponding to a time series electrical digital pixel signal of the image information is outputted. The laser beam L enters the cartridge 2 through an exposure window 53 provided in an upper surface of the cartridge 2 to scanningly expose the outer surface of the drum 20. By this, an electrostatic latent image corresponding to the image information is formed on the outer surface of the drum 20. The electrostatic latent image is visualized by a developer T (toner) in a developing device unit 40 into a toner image.

More particularly, the roller 12 is contacted to the drum 20 to charge the drum 20. The roller 12 is driven by the drum 20 to rotate. The unit 40 supplies the toner to a developing zone of the drum 20 to develop the latent image formed on the drum 20. The unit 40 delivers the toner T from the toner chamber 45 into a toner supply chamber 44 by rotation of the stirring member 43. A developing roller 41 which is a developer carrying member containing a magnet roller (fixed magnet) 41*a* is rotated, and a layer of toner triboelectric charged by a developing blade 42 is formed a surface of the roller 41.

The toner is transferred onto the drum 20 in accordance with the latent image so that a toner image is formed to visualize the latent image. The blade 42 functions to regulate an amount of the toner on the peripheral surface of the roller 41 and to apply the triboelectric charge to the toner. On the other hand, in timed relation with output of the laser beam L, the sheet material P is fed from the tray 4 below the main assembly 1 of the apparatus by the roller 5*a*, the roller 5*b* and the roller pair 5*c*. The sheet material P is supplied via a guide 6 to a transfer position between the drum 20 and a roller 7 in timed relation.

In the transfer position, the toner image is transferred sequentially onto the sheet material P from the drum 20. The sheet material P having the transferred toner image is separated from the drum 20 and is fed to a device 9 along a guide 8. The sheet material P passes through a nip between a fixing roller 9*a* and a pressing roller 9*b* which constitutes a device 9. The toner image is subjected to a pressing and heat-fixing process and is fixed on the sheet material P.

The sheet material P having subjected to the toner image fixing process is fed to the roller pair 10, and is discharged to the tray 11. On the other hand, after the transfer, residual toner on the outer surface of the drum 20 is removed by a blade 52 to be prepared for the next image formation starting with the charging. The residual toner removed from the drum 20 is stored in a residual toner chamber 52*a* of a cleaning unit (photosensitive member unit) 50.

In the foregoing, the roller 12, the roller 41, the blade 52 and so on constitutes process means actable on the drum 20.

(Process Cartridge)

Figure 2:
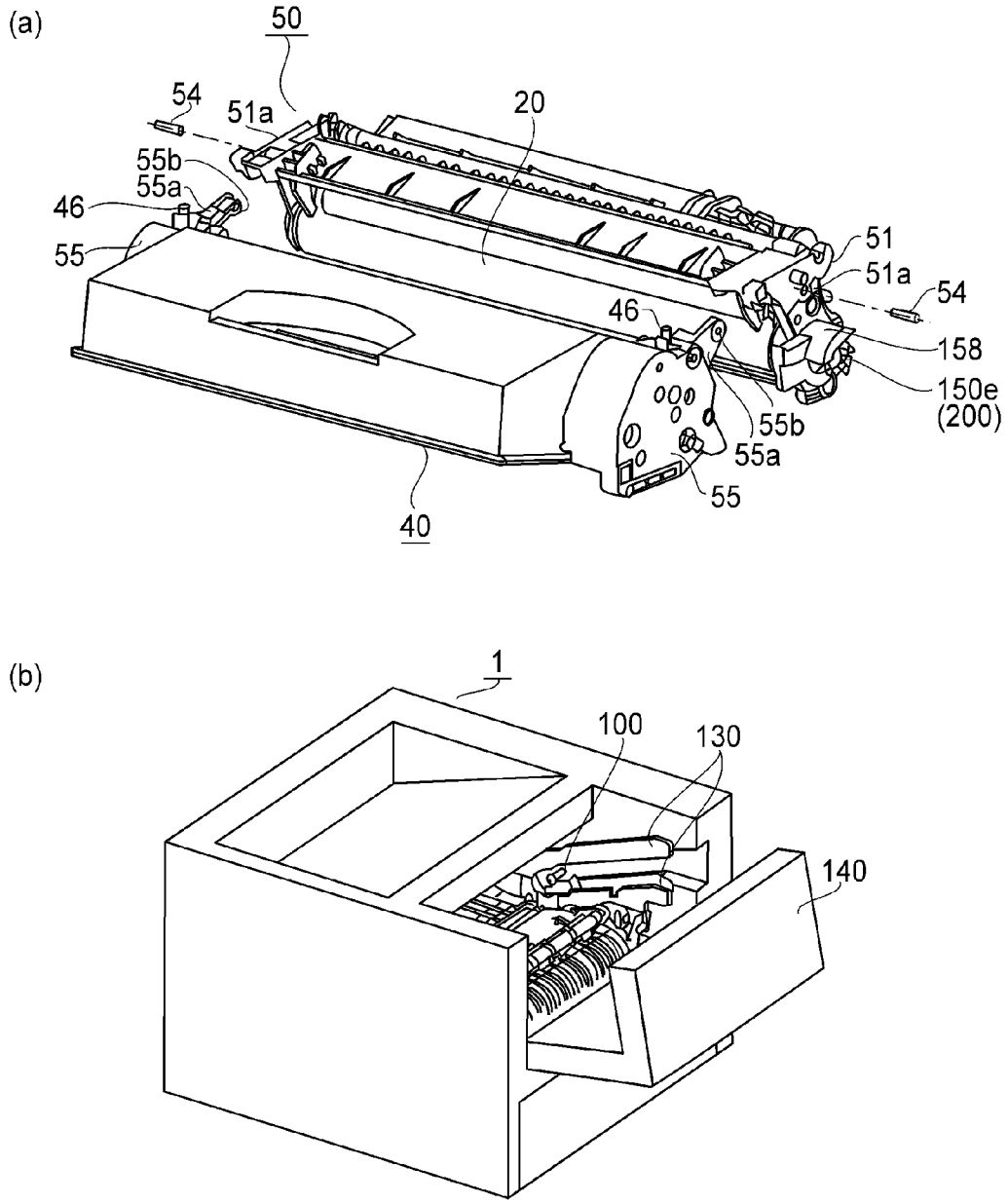

Part (a) of FIG. 2 is a perspective view illustrating a frame structure of the cartridge 2. Referring to part (b) of FIG. 1 and part (a) of FIG. 2, the frame structure of the cartridge 2 will be described. As shown in part (b) of FIG. 1, the drum 20, the roller 12 and the blade 52 are mounted to a drum frame 51 to constitute an integral unit 50.

On the other hand, the unit 40 comprises a toner chamber 45 for accommodating the toner and a toner accommodating container 40*a* having a toner supply chamber 44, and a lid 40*b*. The container 40*a* and the lid 40*b* are connected integrally by means of welding or the like. As shown in part (a) of FIG. 2, the unit 50 and the unit 40 are connected with each other by a coupling member 54 (round pin) so as to rotatable relative to each other, thus constituting a cartridge 2. More particularly, as shown in part (a) of FIG. 2, a side cover 55 provided at each of the longitudinal (axial direction of the roller 41) opposite ends of the unit 40 is provided with an arm portion 55*a* having a free end provided with a circular rotation hole 55*b* extending in parallel with the roller 41.

When the arm portion 55*a* is inserted into the frame 51 to a predetermined position, it enters a fitting hole 51*a* provided in a frame 51 coaxially with the rotation hole 55*b* (left side fitting hole is not shown in part (a) of FIG. 2). By inserting the coupling member 54 into the rotation hole 55*b* and the fitting hole 51*a*, the unit 50 and the unit 40 is connected with each other so as to be rotatable about the coupling member 54.

At this time, a compression coil spring 46 mounted to the base portion of the arm portion 55*a* abuts to the frame 51 to urge the unit 40 downwardly. By this, the roller 41 (part (b) of FIG. 1) is press-contacted to the drum 20 assuredly. Opposite ends of the roller 41 are provided with clearance holding members (unshown) so that the roller 41 is held with a predetermined gap from the drum 20. (Rotational force transmission method to process cartridge)

Part (b) of FIG. 2 is a perspective view of the main assembly 1 of the apparatus with the door 140 opened to show the inside of the main assembly of the apparatus. Here, the cartridge 2 is not mounted. Referring to part (b) of FIG. 2, a rotational force transmission method for cartridge 2 will be described. As shown in part (b) of FIG. 2, the main assembly 1 of the apparatus is provided with a guiding rail 130 for mounting and demounting of the cartridge, and the cartridge 2 is mounted into the main assembly 1 of the apparatus along the rail 130.

At this time, in interrelation with the mounting operation of the cartridge 2, a coupling member 200 (part (a) of FIG. 2) which is a rotational force transmitting part provided on the cartridge 2 is connected with a driving shaft 100 in the main assembly 1 side. By doing so, the drum 20 receives a rotational force from the main assembly 1 of the apparatus to rotate.

(Driving Shaft)

Part (a) of FIG. 3 is a schematic perspective view of the driving shaft 100 of the main assembly 1 of the apparatus. The driving shaft 100 is connected with a motor through the drive transmitting means such as a gear train (unshown) provided in the main assembly 1 of the apparatus. A free end portion 100*a* of the driving shaft 100 has a substantially semi-spherical surface and is provided with a rotational force transmitting pin 100*b* as a rotational force applying portion. By the rotation of the driving shaft 100, a driving force is transmitted to the drum 20.

(Coupling Member)

Part (b) of FIG. 3 is a sectional view of the coupling member 200. Part (c) is a perspective view of the coupling member 200. The coupling member 200 receives a rotational force for rotating the drum 20 from the main assembly 1 of the apparatus in the state that the cartridge 2 is mounted to the main assembly 1 of the apparatus. As shown in parts (b) and (c) of FIG. 3, the coupling member 200 is provided with a rotational force receiving portion 150*e* (150*e*1 to 150*e*4) for receiving the rotational force, at the one end portion side. The other end portion side is provided with a spherical portion (spherical member) 160 to which a pin 155 is mounted by penetration.

Opposite ends of the pin 155 project out of the spherical portion 160, thus providing projected portions 155*a*, 155*b*. In this embodiment, the coupling member 200 is constituted by the rotational force receiving member 150 having the rotational force receiving portion 150*e*, the spherical portion 160 and the pin 155, which are integral with each other. The material of the rotational force receiving member 150 is resin material such as polyacetal, polycarbonate or PPS, for example.

In order to enhance a rigid of the rotational force receiving member 150, glass fibers carbon fibers may be mixed in the resin material depending on the load torque. With the use of the material thus mixed, the rigid of the rotational force receiving member 150 can be enhanced. In addition, the rigid can be further enhanced by inserting a metal member into the resin material, or the entirety of the rotational force receiving member 150 can be made of metal or the like. The spherical portion 160 is made of a resin material such as polyacetal, polycarbonate, PPS, for example. In this embodiment, the rotational force receiving member 150 is made of a zinc alloy, and the spherical portion 160 is made of polyacetal, and the pin is made of stainless steel.

Therefore, the coupling member 200 per se is reusable beyond a lifetime of the cartridge 2. The free end of the rotational force receiving member 150 is provided with a plurality of drive receiving projections 150*d* (150*d*1 to 150*d*4) (part (c) of FIG. 3). The projection 150*d* (150*d*1 to 150*d*4) is provided with a rotational force receiving portion 150*e* (150*e*1 to 150*e*4) which is inclined relative to an axis L150 of the rotational force receiving member 150. Inside the projections 150*d*1 to 150*d*4, there is provided a bowl-like recess 150*f* is provided (part (b) of FIG. 3).

Part (d) of FIG. 3 is a perspective view illustrating the rotational force receiving member 150. Part (e) of FIG. 3 is a perspective view illustrating the spherical portion 160. As shown in part (d) of FIG. 3, a through-hole 150*r* is provided at an end portion 150*s* of the rotational force receiving member 150 opposite the rotational force receiving portion 150*e*.

As shown in part (e) of FIG. 3, the spherical portion 160 connected with the rotational force receiving member 150 has a substantially spherical shape and is provided with a hole 160*a* and a hole 160*b* for insertion of the rotational force receiving member 150 and the pin 155. The blind hole 160*a* having a closed end receives the end portion 150*s* of the rotational force receiving member 150. The through-hole 160*b* receives the pin 155, and penetrates the hole 160*a*.

As shown in parts (b) and (c) of FIG. 3, the rotational force receiving member 150 is inserted into the spherical portion 160 or and the pin 155 is inserted linearly through the through-hole 150*r* and the through-hole 160*b*. In this embodiment, the rotational force receiving member 150 and the hole 160*a* are in a loose fitting relation, the pin 155 and the through-hole 150*r* are in a loose fitting relation, and the pin 155 and the through-hole 160*b* are in a press-fitting relation. Therefore, the pin 155 and the spherical portion 160 are connected integrally with each other.

Between the rotational force receiving portion 150*e* and the spherical portion 160, there is provided a cylindrical portion 150*c* having a diameter smaller than that of the spherical portion 160. When the rotational force is received from the driving shaft 100, the rotational force receiving member 150 rotates about the axis L150 so that the pin 155 engages with the through-hole 150*r*. Thus, the rotational force from the main assembly 1 of the apparatus is converted to a rotational force to the pin 155 about the rotational axis L150 through the rotational force receiving member 150.

(Description of Connection State Between Driving Shaft and Coupling Member)

Part (a) of FIG. 4 is an illustration of a state in which the rotational force receiving member 150 of the coupling member 200 is in engagement with the driving shaft 100. Part (b) is a sectional view illustrating the state of engagement between the rotational force receiving member 150 and the driving shaft 100. Referring to parts (a) and (b) of FIG. 4, the engaging state of the driving shaft 100 and the coupling member 200 will be described.

The rotational force transmitting pin (rotational force applying portion) 100*b* of the driving shaft 100 is engaged with the rotational force receiving portion 150*e* (150*e*1 to 150*e*4). The rotational force transmitting pin 100*b* in the back side is also engaged with the rotational force receiving portion 150*e* although it is not shown in part (a). In addition, a free end portion 100*a* of the driving shaft 100 contacts to the recess 150*f* of the rotational force receiving member 150. By the rotation of the driving shaft 100, the rotational force is transmitted from the rotational force transmitting pin 100*b* to the rotational force receiving portion 150*e*.

Because the rotational force receiving portion 150*e* is inclined relative to the axis L150 of the rotational force receiving member 150, the rotational force receiving member 150 and the driving shaft 100 attracts each other, so that the contact between the free end portion 100*a* and the recess 150*f* is assured, thus accomplishing a stabilized rotational force transmission.

(Description of Drum Flange)

FIG. 5, FIG. 6 and part (a) of FIG. 7 illustrate a drum flange 250 to which the coupling member 200 is mounted. FIG. 5 is a view of the drum flange 250 as seen from the front side. Part (a) of FIG. 6 is a sectional view taken along a line S1-S1 in FIG. 5. Part (b) of FIG. 6 is a sectional view taken along a line S2-S2 in FIG. 5. Part (a) of FIG. 7 is a perspective view of the drum flange 250. As shown in part (b) of FIG. 6, one end portion of the drum flange 250 is provided with an opening 250*a*1 which opens outwardly in the longitudinal direction (outwardly in the longitudinal direction of the cylinder 20A which will be described hereinafter).

The opening 250*a*1 extends, keeping its size (diametrical size), toward the other end portion of the drum flange 250 (in the longitudinal direction of the cylinder 20A, toward the bottom) to the bottom portion (regulating portion) 250*a*2, thus forming a hole portion 250*a*. That is, the hole portion 250*a* extends toward the inside in the longitudinal direction while keeping the size of the opening 250*a*1. The length over which the size of the opening 250*a*1 is kept to the position contacted by the spherical portion 160 of the coupling member 200 accommodated in the opening 250*a*.

The opening 250*a*1 is at the most outside position, with respect to the longitudinal direction, of the hole portion 250*a* having substantially the same diameter as the spherical portion 160 of the coupling member 200.

The hole portion 250*a* comprises the opening 250*a*1, the bottom portion 250*a*2 and a side wall portion 250*a*3 continuously extending from the bottom portion 250*a*2 and is generally cylindrical. In this embodiment, it is circular-cylindrical, but this is not limiting, and may be another such as a circular-columnar or polygonal-columnar shape, if the spherical portion of the coupling member 200 can be accommodated. The circular-cylindrical shape is most easy to machine and manufacture.

Here, a size of the bottom portion 250*a*2 is substantially the same as or smaller than the size of the opening 250*a*1. In other words, as seen from a longitudinally outside position of the cylinder 20A, the bottom portion 250*a*2 at least partly overlapping the opening 250*a*1. That is, the bottom of the hole portion 250*a* of the drum flange 250 has a bottom portion 250*a*2 which at least partly overlaps the opening 250*a*1 as seen from an outside with respect to the longitudinal direction.

As will be described hereinafter, the coupling member 200 can be inserted into the drum flange 250 through an opening 250*a*1 from an outside of the cylinder 20A with respect to the longitudinal direction. And, since the bottom portion 250*a*2 at least part overlaps the opening 250*a*1, the spherical portion 160 of the coupling member 200 passed through the opening 250*a*1 is stopped by the bottom portion 250*a*2. Therefore, the coupling member 200 is not disengaged from the drum flange 250.

Here, the bottom portion (regulating portion) 250*a*2 has been described as being integral with the drum flange 250, but may be an additional member mounted to the drum flange 250. In addition, the bottom portion (regulating portion) 250*a*2 has been described as having one flat surface, but this is not inevitable, and the surface may be a curved surface, a spherical surface, an inclined surface or a surface having pits and projections if the coupling member 200 is not dislodged from the drum flange 250. Or, the bottom portion (regulating portion) 250*a*2 can be formed by a projection or the like if the movement of the coupling member 200 can be limited. Furthermore, in FIG. 5 and FIG. 6, the regulating portion 250*a*2 is provided at the bottom of the hole portion 250*a* of the drum flange 250, but as shown in part (a) of FIG. 25, a drum flange 251 may have a regulating portion 251*a*5 partway of the hole portion 251*a* of the cylinder 20A in the longitudinal direction. With such structures, the coupling member 200 can be inserted into the drum flange 251 through the opening 251*a*1 from a longitudinally outside position of the cylinder 20A. And, the regulating portion 251*a*5 at least a part lays the opening 251*a*1, and therefore, the spherical portion 160 of the coupling member 200 passed through the opening 251*a*1 is limited by the regulating portion 251*a*5. Therefore, the coupling member 200 is not disengaged from the drum flange 251. Part (b) of FIG. 25 shows the state in which the coupling member 200 is inserted. The coupling member 200 is limited by the regulating portion 251*a*5.

A radially outside portion of the hole portion 250*a* is provided with groove portions 250*b*, 250*c*, 250*d*, 250*e* continuously extending from the hole portion 250*a* (groove portions formed continuously from the hole portion). As shown in FIG. 5, the groove portions 250*b* to 250*e* extend radially outwardly of the drum flange 250. Furthermore, as shown in part (a) of FIG. 6, the groove portions 250*b* to 250*e* have a depth substantially equivalent to the depth of the hole portion 250*a* in the longitudinal direction of the drum flange 250.

The groove portion 250*b* and the groove portion 250*d*, and the groove portion 250*c* and the groove portion 250*e*, are in opposite side with respect to a center O (a rotational axis L1 of the cylinder 20A which will be described hereinafter) of the hole portion 250*a* and are opposed to each other. Therefore, the projected portions 155*a*, 155*b* of the coupling member 200 can be accommodated smoothly. In this embodiment, the number of the groove portions 250*b* to 250*e* is four. Since the groove portions accommodate the projected portions 155*a*, 155*b* of the coupling member 200, the number thereof is preferably a multiple of 2. Furthermore, clockwisely upstream of the groove portions 250*b* to 250*e*, there are provided rotational force transmission surfaces (rotational force receiving portions) 250*b*1 to 250*e*1 which will be described in detail hereinafter.

In addition, between the groove portions 250*b* to 250*e*, and radially outside of the opening 250*a*1, there is provided a flat surface portion 250*m*. In addition, in the neighborhood of a center portion of the flat surface portion 250*m*, there are provided fixing hole portions 250*f* to 250*i*. The fixing hole portions 250*f* to 250*i* are disposed concentrically with respect to the center O of the hole portion 250*a*, and are radially equidistant from adjacent groove portion. Closing members 230 which will be described hereinafter (FIG. 8 to FIG. 10) can be fixed to the flat surface portion 250*m* of the drum flange 250.

As shown in part (a) of FIG. 6 and part (a) of FIG. 7, an outer surface of the drum flange 250 is formed into a gear portion 250*j* to transmit a drive to the roller 41 through a gear (unshown). In a longitudinally outside portion of the gear portion 250*j*, there is provided an engaging portion 250*k* supported by the drum bearing 158 (part (a) of FIG. 2) fixed to the frame 51 to support the drum 20 by the frame 51. Furthermore, longitudinally inside of the gear portion 250*j*, there is provided an engaging portion 250*l* for supporting the drum flange 250 by the cylinder 20A which will be described hereinafter.

Here, as shown in part (a) of FIG. 6, the groove portions 250*b* to 250*e* are so disposed as to overlap the gear portion 250*j* with respect to the longitudinal direction. By the overlapping arrangement between the gear portion 250*j* and the groove portions 250*b* to 250*e* with respect to the longitudinal direction, the entire drum flange 250 can be downsized. An inner surface of the engaging portion 250*k* of the drum flange 250 is formed into a cylindrical surface 250*n* and functions to position the closing members 230 (FIG. 8 to FIG. 10) which will be described hereinafter.

(Assembling Method of Photosensitive Drum Unit U1)

Referring to parts (b) and (c) of FIG. 7, an assembling method of the photosensitive drum unit U1 will be described. First, a cylinder 20A which is a main body of the photosensitive drum 20 is prepared. The cylinder 20A is provided with a photosensitive layer at the peripheral surface thereof. The photosensitive layer senses a laser beam to form an electrostatic latent image. The cylinder 20A is hollow-cylindrical, and has openings 20*a*, 20*b* at the opposite longitudinal end portions, respectively.

First, the drum flange (second drum flange) 350 is inserted into the opening 20*b* of the cylinder 20A. The drum flange 350 is provided therein with a grounding metal plate 351 for grounding, which contacts an inner surface of the cylinder 20A. Then, the drum flange 250 is inserted into another opening 20*a* of the cylinder 20A. The drum flange 250 is inserted while aligning the engaging portion 250*l* with the opening 20*a*. Thereafter, the drum flange 250 is fixed to the cylinder 20A [i) drum flange mounting step]. The fixed method may be bonding, press-fitting or the like.

Thus, the photosensitive drum unit U1 is completed (part (c) of FIG. 7). The unit U1 comprises the cylinder 20A, the drum flange 350 and the drum flange 250.

(Assembling Method of Photosensitive Drum Unit U2)

Referring to FIG. 8 to FIG. 10, an assembling method of the photosensitive drum unit U2 will be described. The unit U2 is assembled using the above-described assembled unit U1, and therefore, the unit U1 is first prepared. Then, the coupling member 200 is prepared, and the spherical portion 160 at one end portion of the coupling member 200 is inserted into the hole portion 250*a* through the opening 250*a*1 of the drum flange 250 in the direction of an arrow X1 (part (a) of FIG. 8) [ii) coupling member mounting step].

As described hereinbefore, the size of the opening 250*a*1 is substantially the same as the diameter of the spherical portion 160, and therefore, the coupling member 200 can pass through the opening 250*a*1. In addition, the size of the bottom portion 250*a*2 of the drum flange 250 is equivalent to or smaller than the size of the opening 250*a*1, and therefore, the spherical portion 160 can not pass through the bottom portion (regulating portion) 250*a*2. In other words, the bottom portion 250*a*2 limits movement of the spherical portion 160.

The projected portions 155*a*, 155*b* (part (c) of FIG. 3) projected from the spherical portion 160 are accommodated either two of the groove portions 250*b* to 250*e* (FIG. 5) formed continuously with the hole portion 250*a*. In this embodiment, they are accommodated in the groove portions 250*b*, 250*d*.

Thereafter, the two closing members 230 are mounted to the drum flange 250 [iii) closing member mounting step].

The two closing members 230 have the same configurations. Part (b) of FIG. 8 to part (a) of FIG. 10 show the closing member 230. Part (b) of FIG. 8 is a view of the closing member 230 as seen from the front side, and part (a) of FIG. 9 is a view of the closing member 230 as seen from the back side. Part (b) of FIG. 9 is a view as seen in a direction of an arrow G of the part (b) of FIG. 8. Part (a) of FIG. 10 is a perspective view of the closing member 230.

The closing member 230 is semicircular, and a radius D of an inner surface portion (regulating portion) 230*a* is larger than a radius of the cylindrical portion 150*c* of the coupling member 150 shown in part (c) of FIG. 3 and is smaller than the radius of the spherical portion 160. Around the inner surface portion 230*a*, fixing hole portions 230*b* to 230*c* are provided penetrating the closing member 230.

As shown in parts (a) and (b) of FIG. 9, a back side of the closing member 230 is provided with a spherical surface portion 230*d* continuing from the inner surface portion 230*a*. An outside cylindrical surface of the closing member 230 functions as a positioning surface 230*e*. An inclined surface 230*f* is formed from the inner surface portion 230*a* toward the outside. The inclined surface 230*f* provides a relief to avoid interference even if the coupling member 200 inclines relative to the drum flange 250. Therefore, the pivoting motion of the coupling member 200 about the spherical portion 160 is possible.

As shown in part (a) of FIG. 8, first, the positioning surfaces 230*e* of the closing members 230 are aligned with the cylindrical surface 250*n* of the drum flange 250, and the closing members 230 are inserted. The diameter of the positioning surface 230*e* is substantially the same as the diameter of the cylindrical surface 250*n*. In addition, the radius D of the inner surface portion 230*a* is larger than the diameter of the cylindrical portion 150*c* of the coupling member 200, and therefore, the insertion is possible. Thereafter, the fixing hole portions 230*b* to 230*c* are rotated along the cylindrical surface 250*n* so that they are met with the fixing hole portions 250*f* to 250*i* of the drum flange 250. Thereafter, the closing members 230 are fixed to the flat surface portion 250*m* of the drum flange 250 with screws 61 to 64.

As another fixing method of the closing member 230 to the drum flange 250, a double coated tape may be fixed to the back side of the closing member 230, and may be fixed to the flat surface portion 250*m* of the drum flange 250 by an adhesion thereof. Or, a snap fit mechanism may be provided on the closing member 230 and the drum flange 250, and the closing member 230 may be fixed to the flat surface portion 250*m* by an elastic force of the snap fit.

Part (b) of FIG. 10 is a sectional view of the drum unit U2 after the assembling. The closing members 230 are mounted so as to partially cover the opening 250*a*1 of the drum flange 250. The radius D of the inner surface portion 230*a* of the closing member 230 is smaller than a radius M of the spherical portion 160 of the coupling member 150. In the longitudinal direction of the drum flange 250 (rotational axis L1 direction), the position of the inner surface portion 230*a* is more outside than the center Q of the spherical portion 160.

Therefore, the inner surface portion (regulating portion) 230*a* limits the movement of the spherical portion 160 of the coupling member 200 longitudinally outwardly (outward in the direction of the rotational axis L1). Thus, the coupling member 150 is supported by the drum flange 250 and is not dislodged from the photosensitive drum unit U2. In addition, in the side opposite from the closing member 230 with respect to the longitudinal direction of the drum flange 250, the bottom portion (regulating portion) 250*a*2 of the drum flange 250 is provided, and therefore, the coupling member 200 limits the longitudinally inward (inward in the direction of the rotational axis L1) movement.

When two closing members 230 are assembled into the drum flange 250, the closing members 230 are positioned so as not to cover the groove portions 250*b*, 250*d* as seen from the outside in the direction of the rotational axis L1 of the drum flange. By doing so, the rotation of the pins 155 of the coupling member 200 about the spherical portion 160 is not prevented. Part (a) of FIG. 11 is a view of the coupling unit U2 as seen from the coupling member 200 side in which the rotational force receiving member 150 which is a part of the coupling member 200 is omitted partly.

Since the closing members 230 do not cover the groove portions 250*b*, 250*d*, the pin 155 can move in the direction perpendicular to the sheet of the drawing about the spherical portion 160. In other words, it is rotatable center is spherical portion 160. The drum flange 250 is provided with a plurality of closing members 230, and the groove portions 250*b*, 250*d* accommodating the projected portions 155*a*, 155*b* are not covered by the closing members 230.

Part (b) of FIG. 11 shows the unit U2 after the assembling. The rotational force transmitted to the rotational force receiving portion 150*e* from the rotational force transmitting pin 100*b* of the driving shaft 100 is transmitted to the pin 155 of the coupling member 200. Thereafter, projected portions 155*a*, 155*b* (part (c) of FIG. 3) at the opposite ends of the pin 155 abuts two of the rotational force transmission surfaces 250*b*1 to 250*e*1 (FIG. 5) to transmit the rotational force (in part (a) of FIG. 11, the surfaces 250*b*1, 250*d*1 are abutted). Finally, the cylinder 20A can rotate in a predetermined rotational moving direction.

Thereafter, the unit U2 is supported by the frame 51 together with the drum bearing 158 (part (a) of FIG. 2) to form the cartridge 2.

As described in the foregoing, it is not necessary to assemble the coupling, the spherical member and the drive transmission pin into the flange, respectively, as required in the patent specification 1. In other words, the coupling member 200 can be assembled into the drum flange 250, integrally with the spherical portion 160, the rotational force receiving member 150 and the pin 155. The pin can be manufactured integrally with the spherical member or the rotational force receiving member.

The unit U1 is a unit which can be simply and easily assembled into the unit U2 only by using the closing member 230 for mounting the coupling member 200. Therefore, if the drum unit U1 is prepared, the coupling member 200 or the closing member 230 is procured separately, and it is assembled in the unit U2. At this time, the coupling member 200 or the closing member 230 may be a new part or a recycled part. The unit U2 is a unit provided by mounting the coupling member 200 by the simple and easy method.

The unit U1 has been described as a unit not including the closing member 230. However, it may be a photosensitive drum unit U3 including the closing member 230. FIG. 12 shows the unit U3. Unit U3 includes a set of the unit U1 and the closing member 230, and therefore, the unit U2 can be assembled simple and easy only if the coupling member 200 is procured separately.

Here, unit U3 includes the screws 61 to 64, but this is not inevitable. The closing member 230 is not fixed to the drum flange 250, but it may be fixed beforehand. In such a case, after the procurement of the coupling member 200, the coupling member 250 may be mounted.

(Removing Method of Coupling Member)

Dismounting method for dismounting the coupling member 200 from the unit U2 (disassembling method of the photosensitive drum unit of dismounting the coupling member from the photosensitive drum unit) will be described. The removing method (disassembling method) is generally reverse of the assembling method of the unit U2. An exhausted cartridge 2 is collected by the printer maker or by a specialized collector. Then, reusable parts are taken out of the cartridge.

First, the unit U2 is taken out of the cartridge 2. The cylinder 20A of the unit U2 has a coated photosensitive layer at its peripheral surface, but since the photosensitive layer is scraped by the blade 52 or the like, the photosensitive layer is non-reusable in most cases at the end of the lifetime of the cartridge. On the other hand, the coupling member 200 is reusable in many cases because it does not have many sliding positions. Therefore, as regards the unit U2, the cylinder 20A, the drum flange 250, the drum flange 350 and so on connected cylinder 20A by clamping or the like are abolished, and the coupling member 200 is reused in many cases.

First, the closing members 230 are dismounted from the drum flange 250 shown in part (a) of FIG. 8 [i) closing member dismounting step]. In the case that they are fixed by the screws 61 to 64, the screws 61 to 64 are removed, and then the closing members 230 are dismounted from the drum flange 250. In the case that they are fixed to the drum flange by the double coated tape or the like, the closing member is removed using a tool or the like. In the case that they are fixed by the snap fit or the like, an external force is applied to the portion producing the elastic force to release the snap fit, and then the closing member is removed.

Thereafter, the coupling member 200 is taken out of the drum flange 250 outwardly of the cylinder 20A in the direction of the axis L1 [ii) coupling member dismounting step]. The closing members 230 have limited the movement of the coupling member 200, and therefore, later the closing members 230 are dismounted, the coupling member 200 can be taken out smoothly from the drum flange 250. As described in the foregoing, the coupling member 200 can be dismounted from the unit U2 easily. In other words, a photosensitive drum unit U2 from which the coupling member 200 can be easily dismounted.

[Embodiment 2]

A second embodiment of the present invention will be described. In the description of this embodiment, the same reference numerals as in the foregoing embodiment are assigned to the elements having the corresponding functions in this embodiment, and the detailed description thereof is omitted for simplicity, and the description will be made as to the structures and operations different from the foregoing embodiment.

The points of this embodiment significantly different from Embodiment 1 will be described. In Embodiment 1, the coupling member 200 comprises the rotational force receiving member 150, the spherical portion 160 and the pin 155. In this embodiment, the coupling member comprises a spherical portion and a pin which are unified. Part (a) of FIG. 13 illustrates a rotational force receiving member 401 of a coupling member 400. As is different from Embodiment 1, one end portion of the rotational force receiving member 401 is provided with a male screw portion 401*a* as a portion-to-be-engaged. The other end portion of the rotational force receiving member 401 is provided with a rotational force receiving portion 401*c*.

Part (b) of FIG. 13 illustrates a spherical member 402 of the coupling member 400 of this embodiment. The spherical portion 160 and the pin 155 of Embodiment 1 are unified, as is significantly different from embodiment 1. The spherical member 402 is provided with a spherical portion 402*a* and projected portions 402*b*, 402*c* projected from the spherical portion 402*a*. Center axes of the projected portions 402*b*, 402*c* are aligned with a center of the spherical portion 402*a*. One end portion of the spherical portion 402*a* is provided with a screw portion (engaging portion) 402*d* for engaging with the male screw portion 401*a* of the rotational force receiving member 401.

Part (a) of FIG. 14 is a sectional view illustrating a state in which the rotational force receiving member 401 and the spherical member 402 are connected with each other. The male screw portion 401*a* of the rotational force receiving member 401 is fastened into the screw portion 402*d* of the spherical member 402 to fix the rotational force receiving member 401 to the spherical member 402 (rotational force receiving member inserting step).

A surface-to-be-positioned 401*b* of the rotational force receiving member 401 abuts to a flat positioning surface 402*e* of the spherical member 402 so that the rotational force receiving member 401 is positioned to the spherical member 402. The male screw portion 401*a* and the female screw portion 402*d* are threaded such that when the rotational force receiving member 401 receives a rotational force from the main assembly of the apparatus, they are tightened. Therefore, in operation of the coupling member 400, the rotational force receiving member 401 does not drop off the spherical member 402.

In this example, the rotational force receiving member 401 has the male screw portion 401*a*, and the spherical member 402 has the female screw portion 402*d*, but the male and female may be interchanged. In other words, the rotational force receiving member may have a female screw portion, and the spherical member may have a male screw portion. The material of the spherical member 160 is desirably a metal since the projected portions 402*b*, 402*c* transmit the drive. However, if the diameter of the projected portion is large enough, it may be made of a resin material.

As described in the foregoing, the coupling member 400 comprises the rotational force receiving member 401 and the spherical member 402, so that the number of the parts can be reduced. The assembling is also simple since what is required is substantially only to engage the rotational force receiving member 401 with the spherical member 402.

The rotational force receiving member 401 may be a new part or may be manufactured by machining the rotational force receiving member 150 of embodiment 1. In other words, by providing the rotational force receiving member 150 with a male screw portion 401*a* to manufacture the rotational force receiving member 401.

(Photosensitive Drum Unit U4)

Part (b) of FIG. 14 is a sectional view illustrating a unit U4 comprising the coupling member 400 and a unit U1. In the same method as the assembling method of the unit U2 according to Embodiment 1, the coupling member 400 is prevented from dropping off by the closing members 230. Similarly to the unit U2, the unit U4 is a unit provided by mounting the rotational force receiving member 401 by a simple and easy method. When the rotational force receiving member 401 is dismounted and is reused, it can be dismounted easily only be disengaging the spherical member 402.

(Photosensitive Drum Unit U5)

Part (a) of FIG. 15 is a sectional view illustrating a unit U5 which is the unit U4 from which the rotational force receiving member 401 is removed. The unit U4 is provided with the rotational force receiving member 401, but it may be unified without the rotational force receiving member 401. Therefore, it the unit U5 is prepared, the rotational force receiving member 401 may be procured separately and may be assembled into the unit U4. At this time, the rotational force receiving member 401 may be a new part or a recycled part. The unit U5 can be assembled easily only by fastening the male screw portion 401*a* of the rotational force receiving member 401 into the female screw portion 402*d* of the spherical member 402.

As described in the foregoing, the unit U5 is a unit which can be assembled simply and easily only by preparing the rotational force receiving member 401.

(Photosensitive Drum Unit U6)

Part (b) of FIG. 15 is a sectional view of a unit U6. The unit U6 will be described with respect to the points significantly different from unit U5. In the unit U5, in order to limit outward movement of the spherical portion 402*a* in the longitudinal direction of the cylinder 20A, the use is made with a closing member 230 mounted to the drum flange 250.

On the other hand, in the unit U6, in order to limit the outward movement of the spherical portion 402*a* in the longitudinal direction of the cylinder 20A, the use is made with a regulating portion 410*a* provided on the drum flange 410. A radius E of the regulating portion 410*a* is smaller than a radius of the spherical portion 402*a* of the spherical member 402. And, in the longitudinal direction (rotational axis L1 direction) of the drum flange 410, the position of the regulating portion 410*a* is outside of the center R of the spherical portion 402*a*.

Therefore, the regulating portion 410*a* limits the outward movement of the spherical portion 402*a* of the spherical member 402 in the longitudinal direction (rotational axis L1 direction). In an opposite side of the drum flange 410 with respect to the regulating portion 410*a*, a bottom closing member (retaining portion) 420 is provided, and therefore, the inward movement of the spherical portion 402*a* in the longitudinal direction (rotational axis L1 direction) is also limited.

(Photosensitive Drum Unit U7)

FIG. 16 is a sectional view of a unit U7 in which the rotational force receiving member 401 is mounted. The unit U7 can be assembled easily only by fastening the male screw portion (portion-to-be-engaged) 401*a* of the rotational force receiving member 401 procured separately into the female screw portion (engaging portion) 402*d* of the spherical member 402 of the unit U6 (rotational force receiving member insertion step). Similarly to the unit U4, the unit U7 is a unit provided by mounting the rotational force receiving member 401 by a simple and easy method.

When the rotational force receiving member 401 is dismounted and is reused, it can be dismounted easily only be disengaging the spherical member 402. Similarly to the unit U5, the unit U6 is a unit which can be assembled into a unit U7 simply and easily only by preparing the rotational force receiving member 401.

[Embodiment 3]

A third embodiment of the present invention will be described. In the description of this embodiment, the same reference numerals as in the foregoing embodiments are assigned to the elements having the corresponding functions in this embodiment, and the detailed description thereof is omitted for simplicity, and the description will be made as to the structures and operations different from the foregoing embodiment.

Part (a) of FIG. 17 is a perspective view of a spherical member 502 of this embodiment. Part (b) is a sectional view the spherical member 502 taken along a section S-S. FIG. 18 is a perspective view of the spherical member 502 provided with a reinforcing portion.

As shown in FIG. 17, the spherical member 502 of this embodiment is provided with a female screw portion 502*d*. A size of the female screw portion 502*d* is M6. A rear side of the female screw portion 502*d* is provided with a positioning portion 502*f* for insertion of the portion-to-be-positioned 501*d* of a rotational force receiving member 501 which will be described hereinafter. Between the positioning portion 502*f* and the female screw portion 502*d*, an inclined surface 502*h* is provided. A flat positioning surface 502*e* is provided at an end portion of the female screw portion 502*d*.

The length L1 of the female screw portion 502*d* and a total length L2 of the positioning portion 502*f* and the inclined surface 502*h* satisfy L1<L2. In a specific example, L1 is 3.5 mm, and L2 is 4.7 mm.

In addition, projected portions 502*b*, 502*c* are projected from a spherical portion 502*a*. The projected portions 502*b*, 502*c* transmits the driving force received by the rotational force receiving member 501 to a drum flange 250. When the spherical member 502 is manufactured from a resin material, a reinforcing portion 502*g* shown in FIG. 18 may be provided in an upstream side with respect to a rotational moving direction of the rotational force receiving member 501.

FIG. 19 shows the rotational force receiving member 501 of this embodiment. Part (a) is a perspective view of the rotational force receiving member 501, and part (b) is a sectional view of the rotational force receiving member 501 taken along a section S-S. At the one end portion of the rotational force receiving member 501 is provided with a male screw portion 501*a* as a portion-to-be-engaged. The dimension of the male screw portion 501*a* is also M6, similarly to the female screw portion 502*d*.

At an end portion of the male screw portion 501*a*, there is provided a portion-to-be-positioned 501*d* for positioning the rotational force receiving member 501 relative to the spherical member 502 by engagement with the positioning portion 502*f*. The other end portion of the rotational force receiving member 501 is provided with a rotational force receiving portion 501*c*. Between the portion-to-be-positioned 501*d* and the male screw portion 501*a*, an inclined surface 501*h* is provided. A length M1 of the male screw portion 501*a* and a total length M2 of the portion-to-be-positioned 501*d* and the inclined surface 501*h* satisfy M1<M2. In a specific example, M1 is 3.0 mm, and M2 is 4.45 mm.

FIG. 20 illustrates a coupling member 500 comprising the rotational force receiving member 501 and the spherical member 502. Part (a) is a perspective view of the coupling member 500, and (b) is a sectional view of the coupling member 500 taken along a section S-S. A surface to be positioned 501*b* provided in the rotational force receiving member 501 is abutted to the positioning surface 502*e* provided in the spherical member 502, by which the rotational force receiving member 501 is positioned to the spherical member 502.

Since the length L1 of the female screw portion 502*d* of the spherical member 502 and a total length L2 of the positioning portion 502*f* and inclined surface 502*h* satisfies L1<L2, the positioning between the spherical member 502 and the rotational force receiving member 501 is effected prior to engagement between the male screw portion 501*a* and the female screw portion 502*d*. The positioning portion 502*f* is cylindrical. A center of the positioning portion 502*f* is substantially aligned with the center of the spherical portion 502*a*.

Therefore, the screw engagement starts in the state that the rotational force receiving member 501 and the axis of the spherical member 502 are aligned (positioned state). In addition, the rotational force receiving member 501 and the spherical member 502 are easily aligned, and therefore, the rotational force transmission accuracy is improved. The threading directions of the screws are similar to those in embodiment 2. The inclined surface 502*h* is provided between the positioning portion 502*f* and the female screw portion 502*d*, and therefore, the portion-to-be-positioned 501*d* can be directed into the positioning portion 502*f*, by which the rotational force receiving member 501 and the spherical member 502 are easily assembled.

[Embodiment 4]

A fourth embodiment of the present invention will be described. In the description of this embodiment, the same reference numerals as in Embodiment 1 are assigned to the elements having the corresponding functions in this embodiment, and the detailed description thereof is omitted for simplicity.

Part (a) of FIG. 21 a front view of a drum flange 550 as seen from a front side, and part (b) is a perspective view thereof. Flat surface portions 550*m* are provided between the groove portions 550*b* to 550*e* and radially outside of an opening 550*a*1. In addition, in the neighborhood of a center portion of the flat surface portion 550*m*, there are provided fixing hole portions 550*f*1 to 550*f*4. On the flat surface portions 550*m*, there are provided positioning projections 550*n*1 to 550*n*4 for positioning closing members 530 which will be described hereinafter relative to the drum flange 550. Diameters of the positioning projections 550*n*1 to 550*n*4 are 1.0 mm, and a height thereof is 2.0 mm.

Part (a) of FIG. 22 is a perspective view of the closing member as seen from a back side, (b) is a perspective view of the closing member as seen from a front side, and (c) is a perspective view showing a state in which the drum flange, the closing member and the coupling member are fixed.

The closing member 530 is provided with holes-to-be-positioned 530*g*1, 530*g*2 for engaging with the positioning projections 550*n*1 to 550*n*4. The hole-to-be-positioned 530*g*1 is a cylindrical hole having a diameter of 1.0 mm and a depth of 2.45 mm. Therefore, one of the positioning projections 550*n*1 to 550*n*4 can be inserted into the hole-to-be-positioned 530*g*1. The hole-to-be-positioned 530*g*2 has an elongated hole configuration, and another one of the positioning projections 550*n*1 to 550*n*4 is inserted into the hole-to-be-positioned 530*g*2. Thus, the position of the closing member 530 is determined relative to the drum flange 550.

The closing member 530 is provided with holes 530*h*1, 530*h*2 through which screws 561 are penetrated. Finally, the coupling member 200 is fixed to the drum flange 550 by screws 561 through the holes 530*h*1, 530*h*2. The size of the screws 561 is M2, and the screws 561 are tap tight screws. A diameter head portions 561*a* of the screws 561 is 3.0 mm, and a height of the head portions 561*a* is 0.6 mm. Using the tap tight screws such dimensions, the head portions 561*a* of the screws 561 do not interfere the coupling member 200 even when the coupling member 200 are inclined relative to the drum flange 250.

Similarly to the Embodiment 1, a spherical surface portion 530*d* and an inclined surface 530*f* are provided. Similarly to Embodiment 1, two closing members 530 are used to fix the coupling member 200.

[Embodiment 5]

A fifth embodiment of the present invention will be described. In the description of this embodiment, the same reference numerals as in Embodiment 4 are assigned to the elements having the corresponding functions in this embodiment, and the detailed description thereof is omitted for simplicity.

Part (a) of FIG. 23 is a perspective view of a closing member 630 of this embodiment as seen from a front side, part (b) is a perspective view of the closing member 630 of this embodiment as seen from a back side, and part (c) is a perspective view illustrating a state in which a drum flange 550, the closing member 630 and a coupling member 200 are fixed.

In Embodiment 1, two closing members 230 are using, but in this embodiment, one closing member 630 is used. The coupling member 200 is accommodated in the drum flange 550 by the closing member 630. In Embodiment 1, the closing member 230 does not cover the groove portions 250*b*, 250*d* so as to permit movement of the pin 155. Therefore, two closing members 230 are used in embodiment 1. In this embodiment, the closing member 630 has a recess 630*a* which is large enough to permit movement of the pin 155. An outside of the recesses 630*a* are connected by a connecting portion 630*b* to be unified. A thickness of the connecting portion 630*b* measured in the radial direction is approx. 1.35 mm.

Furthermore, the closing member 630 is provided with a hole-to-be-positioned 630*g*1 and an elongated hole-to-be-positioned 630*g*2, similarly to the embodiment 4. In addition, it is provided with holes 630*h*1, 630*h*2 for relief for those projections of the positioning projections 550*n*1 to 550*n*4 of the drum flange 550 which are not engaged with the hole-to-be-positioned 630*g*1, 630*g*2.

A diameter of the holes 630*h*1, 630*h*2 is 1.3 mm. Thus, the positioning projections 550*n*1 to 550*n*4 having a diameter of 1.0 mm do not contact the holes 630*h*1, 630*h*2. Therefore, the position of the closing member 630 relative to the drum flange 550 is determined correctly. Similarly to the Embodiment 4, an inclined surface 630*f* and holes 630*j* through which a screw is penetrated are provided.

Referring to parts (a) when (b) of FIG. 24, an assembling method will be described. The coupling member 200 is divided into a rotational force receiving member 150 and a spherical portion 160. The rotational force receiving member 150 is inserted into the closing member 630. Thereafter, the spherical portion 160 is inserted into the rotational force receiving member 150, and then, the spherical portion 160 and the rotational force receiving member 150 are connected with each other by a pin 155. By doing so, the coupling member 200 and the closing member 630 are unified. The closing member 630 is provided with a spherical surface portion 630*d* similarly to the embodiment 4. Therefore, the coupling member 200 is not disengaged from the closing member 630.

The unified coupling member 200 and closing member 630 is fixed to the drum flange 550 by a screw 561, thus forming a drum unit similarly to the embodiment 1.

According to this embodiment, the closing member 630 can be unified, and therefore, the number of parts can be reduced.

[Industrial Utility]

As described in the foregoing, according to the present invention, there are provided a photosensitive drum unit in which the coupling member can be easily mounted, a photosensitive drum unit in which the coupling member can be easily dismounted, an assembling method for the photosensitive drum unit in which the coupling member can be easily mounted, and a disassembling method for the photosensitive drum unit in which the coupling member can be easily dismounted.

The invention claimed is:

1. A photosensitive drum unit to which a coupling member is mountable, the coupling member including (1) a rotational force receiving portion for receiving a rotational force at one end portion side thereof, (2) a spherical portion at another end portion side thereof, and (3) a projected portion projected from the spherical portion, said photosensitive drum unit comprising:

a cylinder provided with a photosensitive portion at a peripheral surface thereof;

a drum flange provided at one end portion of said cylinder and including (A) a hole portion which opens outwardly in a longitudinal direction of said cylinder and which has an opening capable of accommodating the spherical portion, (B) a groove portion which continues from said hole portion and which is capable of accommodating the projected portion, and (C) a limiting portion for limiting inward movement of the spherical portion in the longitudinal direction of said cylinder; and a closing member capable of partially covering said opening of said hole portion and mounted to said drum flange to limit outward movement of the spherical portion in the longitudinal direction of said cylinder, wherein said closing member is constituted by a plurality of independent pieces.

2. A photosensitive drum unit according to claim 1, wherein said hole portion is cylindrical.

3. A photosensitive drum unit according to claim 1, wherein said drum flange is provided with a gear portion at an outer surface thereof, and wherein said gear portion and said groove portions are overlapped in the longitudinal direction of said cylinder.

4. A photosensitive drum unit according to claim 1, wherein said groove portion is formed by a plurality of groove portions that are opposed to each other interposing a rotational axis of said cylinder therebetween.

5. A photosensitive drum unit according to claim 1, wherein said drum flange has a plurality of flat surface portions between said groove portion and outside said opening, and said closing member is capable of being fixed to said drum flange at the flat surface portions.

6. A photosensitive drum unit according to claim 5, wherein said flat surface portions are provided with hole portions through which said closing member is capable of being fixed to said drum flange by screws.

7. A photosensitive drum unit according to claim 5, wherein said closing member is capable of being fixed to said flat surface portions by a double coated tape.

8. A photosensitive drum unit according to claim 5, wherein said flat surface portion is provided with a positioning portion for positioning said closing member, and said closing member is provided with a positioned portion to be engaged with said positioning portion.

9. A photosensitive drum unit according to claim 1, wherein a gap of a predetermined width is provided between adjacent ones of said pieces, and the gap is overlapped with the groove portion.

10. A photosensitive drum unit according to claim 1, wherein said closing member is provided with a concave spherical portion contactable to said sperical portion of said coupling member.

11. A photosensitive drum unit comprising:

a photosensitive drum having a cylinder provided with a photosensitive portion at a peripheral surface thereof;

a coupling member for receiving a rotational force for rotating said photosensitive drum, said coupling member including (1) a rotational force receiving portion for receiving a rotational force at one end portion side thereof, (2) a spherical portion at another end portion side thereof, and (3) a projected portion projected from the spherical portion;

a drum flange provided at one end portion of said cylinder and including a hole portion which opens outwardly in a longitudinal direction of said cylinder and which has (A) an opening capable of accommodating said spherical portion, (B) a groove portion which continues from said hole portion and which is capable of accommodating said projected portion, said groove portion being capable of receiving the rotational force from said projected portion, and (C) a limiting portion for limiting inward movement of said spherical portion in the longitudinal direction of said cylinder; and a closing member partially covering said opening of said hole portion and mounted to said drum flange to limit outward movement of said spherical portion in the longitudinal direction of said cylinder, wherein said closing member is constituted by a plurality of independent pieces.

12. A photosensitive drum unit according to claim 11, wherein a gap of a predetermined width is provided between adjacent ones of said pieces, and the gap is overlapped with said groove portion.

13. A photosensitive drum unit according to claim 11, wherein said hole portion is cylindrical.

14. A photosensitive drum unit according to claim 11, wherein said drum flange is provided with a gear portion at an outer surface thereof, and wherein said gear portion and said groove portion are overlapped in the longitudinal direction of said cylinder.

15. A photosensitive drum unit according to claim 11, wherein said groove portion is formed by a plurality of groove portions that are opposed to each other interposing a rotational axis of said cylinder therebetween.

16. A photosensitive drum unit according to claim 11, wherein said drum flange has a plurality of flat surface portions between said groove portion and outside said opening, and said closing member is capable of being fixed to said drum flange at said flat surface portions.

17. A photosensitive drum unit according to claim 16, wherein said flat surface portions are provided with hole portions through which said closing member is capable of being fixed to said drum flange by screws.

18. A photosensitive drum unit according to claim 16, wherein said closing member is capable of being fixed to said flat surface portions by a double coated tape.

19. An assembling method for a photosensitive drum unit, said assembling method comprising:

i) a drum flange mounting step of mounting a drum flange to one end portion of a cylinder having a photosensitive portion at a peripheral surface thereof, said drum flange including a hole portion having an opening which opens outwardly in the longitudinal direction of said cylinder, and a groove portion continuing from said hole portion;

ii) a coupling member mounting step of mounting said coupling member, said coupling member including (A) a rotational force receiving portion for receiving a rotational force at one end portion side thereof, (B) a spherical portion at another end portion side thereof, and (C) a projected portion projected from said spherical portion, and said coupling member mounting step inserting said spherical portion into said hole portion through said opening and inserting said projected portion into said groove portion; and iii) a closing member mounting step of mounting a closing member for partially covering said opening of said hole portion to said drum flange, wherein said closing member is constituted by a plurality of independent pieces.

20. A photosensitive drum unit disassembling method for disassembling a photosensitive drum unit, said photosensitive drum unit including:

(1) a photosensitive drum having a cylinder provided with a photosensitive portion at a peripheral surface thereof, (2) a coupling member for receiving a rotational force for rotating said photosensitive drum, said coupling member including (A) a rotational force receiving portion for receiving a rotational force at one end portion side thereof, (B) a spherical portion at another end portion side thereof, and (C) a projected portion projected from said spherical portion, (3) a drum flange provided at one end portion of said cylinder and including a hole portion which opens outwardly in a longitudinal direction of said cylinder and which has a opening capable of accommodating said spherical portion, (4) a groove portion which continues from said hole portion and which is capable of accommodating said projected portion, and (5) a closing member which is constituted by a plurality of independent pieces and which covers said opening of said hole portion, said closing member being mounted to said drum flange to limit outward movement of said spherical portion in the longitudinal direction of said cylinder, said disassembling method being for removing said coupling member from said photosensitive drum unit and comprising:

i) a closing member dismounting step of dismounting said closing member from said drum flange; and ii) a coupling member dismounting step of dismounting said coupling member from said drum flange.

21. A photosensitive drum unit comprising:

a photosensitive drum having a cylinder provided with a photosensitive portion at a peripheral surface thereof, a rotational force receiving member for receiving a rotational force for rotating a photosensitive drum, said rotational force receiving member including a rotational force receiving portion for receiving a rotational force at one end portion side thereof and a portion-to-be engaged at another end portion side thereof;

a spherical member including a spherical portion, a projected portion projected from said spherical portion, and an engaging portion for engaging with said portion-to-be-engaged;

a drum flange provided at one end portion of said cylinder and accommodating said spherical member, said drum flange including (A) a hole portion which opens outwardly in the longitudinal direction of said cylinder and which has an opening capable of accommodating said spherical portion, (B) a groove portion which continues from said hole portion and which is capable of accommodating said projected portion for receiving the rotational force from said projected portion, and (C) a limiting portion for limiting inward movement of said spherical portion in the longitudinal direction of said cylinder; and a closing member capable of partially covering said opening of said hole portion and capable of being mounted to said drum flange to limit outward movement of said spherical portion in the longitudinal direction of said cylinder, wherein said closing member is constituted by a plurality of independent pieces, wherein one of said engaging portion and said portion-to-be-engaged includes a male screw portion, and the other of said engaging portion and said portion-to-be engaged includes a female screw portion.

22. A photosensitive drum unit comprising:

a photosensitive drum having a cylinder provided with a photosensitive portion at a peripheral surface thereof;

a rotational force receiving member for receiving a rotational force for rotating said photosensitive drum, said rotational force receiving member including a rotational force receiving portion for receiving a rotational force at one end portion side thereof and a portion-to-be-engaged at another end portion side thereof;

a spherical member including a spherical portion, a projected portion projected from said spherical portion, and an engaging portion for engaging with said portion-to-be-engaged;

a drum flange provided at one end portion of said cylinder and accommodating said spherical member, said drum flange including (A) a hole portion which opens outwardly in the longitudinal direction of said cylinder and capable of accommodating said spherical portion, (B) a groove portion which continues from said hole portion and which is capable of accommodating said projected portion for receiving the rotational force from said projected portion, and (C) a retaining portion, provided at one end portion of said hole portion, for limiting inward movement of said spherical portion in the longitudinal direction of said cylinder; and a regulating portion, provided at the other end portion of said hole portion, for limiting outward movement of said spherical portion in the longitudinal direction of said cylinder, wherein said regulating portion is constituted by a plurality of independent pieces, wherein one of said engaging portion and said portion-to-be engaged includes a male screw portion, and the other of said engaging portion and said portion-to-be engaged includes a female screw portion.

* * * * *